US009487887B1

(12) United States Patent
Grossman

(10) Patent No.: US 9,487,887 B1
(45) Date of Patent: Nov. 8, 2016

(54) SYSTEMS AND METHODS FOR MANUFACTURING TEXTILES

(71) Applicant: Jonathan Grossman, Chicago, IL (US)

(72) Inventor: Jonathan Grossman, Chicago, IL (US)

( * ) Notice: Subject to any disclaimer, the term of this patent is extended or adjusted under 35 U.S.C. 154(b) by 345 days.

(21) Appl. No.: 14/210,095

(22) Filed: Mar. 13, 2014

Related U.S. Application Data

(60) Provisional application No. 61/780,031, filed on Mar. 13, 2013.

(51) Int. Cl.

| | |
|---|---|
| ***D01H 4/48*** | (2006.01) |
| ***D03D 49/00*** | (2006.01) |
| ***D02H 1/00*** | (2006.01) |
| ***D03D 45/02*** | (2006.01) |
| ***D03D 51/00*** | (2006.01) |

(52) U.S. Cl.
CPC ..... *D01H 4/48* (2013.01); *D02H 1/00* (2013.01); *D03D 45/02* (2013.01); *D03D 49/00* (2013.01); *D03D 51/00* (2013.01)

(58) Field of Classification Search
CPC ..... D01H 4/48; D01H 15/00; D03D 45/02; D03D 49/00; D02H 1/00; B65H 51/20
See application file for complete search history.

(56) References Cited

U.S. PATENT DOCUMENTS

| | | | | | |
|---|---|---|---|---|---|
| 3,796,032 | A | | 3/1974 | Clontz | |
| 4,031,925 | A | * | 6/1977 | Santucci | D03D 47/00 139/302 |
| 4,116,393 | A | | 9/1978 | Inouye et al. | |
| 4,448,223 | A | * | 5/1984 | Deborde | D03D 47/3013 139/1 E |
| 4,531,385 | A | | 7/1985 | Jacobsson | |
| 4,915,144 | A | * | 4/1990 | Bucher | D03D 47/3046 139/435.1 |
| 4,964,442 | A | * | 10/1990 | Tacq | D03D 47/34 139/452 |
| 4,977,737 | A | * | 12/1990 | Yamada | D01H 5/38 57/264 |
| 5,050,647 | A | * | 9/1991 | Baeck | D03D 47/34 139/116.2 |
| 5,137,059 | A | * | 8/1992 | Baeck | B65H 49/12 139/452 |
| 5,332,007 | A | * | 7/1994 | Wahhoud | D03D 47/342 139/116.2 |
| 5,341,633 | A | * | 8/1994 | Nishikawa | D01H 1/34 57/264 |
| 5,544,679 | A | * | 8/1996 | Tacq | B65H 63/062 139/116.2 |
| 6,260,783 | B1 | | 7/2001 | Realff et al. | |
| 6,845,550 | B2 | | 1/2005 | Kimura et al. | |
| 8,448,891 | B2 | | 5/2013 | Bruynoghe et al. | |
| 2013/0186054 | A1 | | 7/2013 | Dua et al. | |

FOREIGN PATENT DOCUMENTS

| | | | |
|---|---|---|---|
| EP | 0811714 | A1 | 12/1997 |
| EP | 0999299 | A2 | 5/2000 |
| EP | 1342823 | A2 | 9/2003 |
| EP | 1411015 | A2 | 4/2004 |
| EP | 1422179 | A2 | 5/2004 |
| EP | 1741814 | A2 | 1/2007 |
| WO | WO-2012176041 | A2 | 12/2012 |

* cited by examiner

*Primary Examiner* — Shaun R Hurley
(74) *Attorney, Agent, or Firm* — Wilmer Cutler Pickering Hale and Dorr LLP

(57) ABSTRACT

An apparatus for manufacturing textiles includes a creel having mounted thereon a plurality of regenerating yarn packages and a yarn extension device having a first plurality of inputs each coupled to a strand of yarn from one of the plurality of yarn packages, a second plurality of inputs each coupled to a strand of yarn from one of the plurality of regenerating yarn packages, and a yarn joining device operative to join a first strand of yarn from one of the first plurality of inputs to a second strand of yarn from one of the second plurality of inputs to create a joined strand of yarn.

18 Claims, 44 Drawing Sheets

3 members of the twill family, all could be used as pencil tips on a fabric with twill weave

SYSTEMS AND METHODS FOR MANUFACTURING TEXTILES

CROSS REFERENCE TO RELATED APPLICATION

This application claims priority to U.S. Provisional Patent Application No. 61/780,031, filed Mar. 13, 2013, which is incorporated by reference in its entirety as though fully disclosed herein.

TECHNICAL FIELD

This application relates generally to woven textile manufacturing, and more specifically to systems and methods to facilitate cost-effective short-run, on-demand woven textile manufacturing.

BACKGROUND OF THE INVENTION

While many industries have shifted towards efficient, on-demand, one-off processes, the textile industry has remained relatively inert. Keeping textile manufacturing on the outskirts of the mass-customization revolution are two barriers—first, the programs used for designing textiles require significant amounts of training, and second, the actual manufacture of the textile is constrained by fixed costs that require the spreading of a design over as many yards as possible, as well as issues of flexibility, making small orders prohibitive from a price stand point. Perhaps the reason why these barriers both remain unfixed is because to remedy one while not fixing the other means either having the ability for mass and costless design of textiles without the manufacturing process to support the effort, or having a manufacturing process ready for on-demand, one-off orders without the design simplicity for orders to actually be submitted. This invention attempts to tackle both issues in order to create an efficient, cost-effective, on-demand, very short-run textile manufacturing process.

A textile has a plurality of warp yarns crossing a plurality of weft yarns, which may be indistinguishable in final fabric form as the intertwining of sheets of thousands of parallel yarns. However, the warp and the weft actually arrive at their crossing point in very different ways. The warp uses a plurality of yarn packages to create its parallel web of yarns, while the weft is merely the repeated insertion of short sections of yarn from a single yarn package. Yarn packages can also be referred to as yarn bobbins, inventoried yarn, or spools of yarn.

Once the warp yarns are introduced to a weaving machine, lifting them for desired weaves and inserting the weft are automatic processes. The only labor needed at the point of weaving is for tying warp yarns when, every once in a while, they happen to break during weaving. The weaving process typically proceeds as follows. First, an inventory of yarn is procured. Those yarns are then collected via a warping method, and that collection is then tied into a weaving machine. In order to properly prepare the warp yarns for the weaving machine, they must be formed into a web of parallel yarns. To do so, yarn packages are placed on creels (racks that hold the yarn packages), properly tensioned, and dragged onto a warp beam. Yarn from these yarn packages is subsequently spun to form sheets of parallel yarns of proper number and length. Each of these methods, however, presents discontinuities in the process of turning yarn into fabric and usually requires many hours of labor.

There are different ways of manipulating yarns into a warp, and each is essentially a trade-off between the amount of time spent placing packages and the amount of time spent rotating a warp beam. We can see the inverse relationship of those costs in three methods—direct beaming (FIG. 2), sectional warping (FIG. 3) and sample warping. In direct beaming, each warp yarn corresponds with a yarn package and the entire width of the warp is accounted for by the creeling of thousands of yarn packages. Therefore, much time is spent placing yarn packages and less time is spent rotating the warp onto the beam. Sectional warping substitutes creeling time for beaming time—fewer yarn packages are placed on the creel (around 80-800), but many sections must be rotated on the warp beam for a textile of equal width. Sample warping is a further extension of this idea. Even fewer yarn packages are placed on the creel (between 1 and 24), but much time is spent rotating the yarn around a drum to build up a warp of equal width. All the aforementioned methods require various degrees of labor, and also present a bottleneck in the process of turning yarn into a warp for weaving.

To enable a more continuous process, the idea of creating a warp beam must be disposed of. In order to go straight from yarn packages to weaving machine, one might employ a method called direct weaving (FIG. 1) or creel weaving, though it has its own limitations. It is the most continuous process as a creel of yarn can go directly into the weaving machine, but it requires much time spent placing yarn packages onto the creel. Furthermore, as the number of yarns in the warp increase, the creel must become physically larger, and the differential in distance between the yarn packages at the front and back of the creel causes a problem. The greater the distance the yarn takes on its path to the weaving machine, the more length of yarn dangling, the greater the weight on the passing yarn, and the greater the tension at the point of weaving. The tension differential between the yarns in the warp causes major problems in weaving, from unsellable, slack or puckering fabric, to broken threads that can slow down or prevent weaving entirely.

It should be clear that the two problems that hold manufacturing efficiency hostage are the heavy labor involvement of setting up a warp, and the discontinuities in the process. Various attempts have been made to deal with these issues. One such model attempts to spread the large set-up costs of warp creation over a few connected, smaller warps by joining yarn lengths to each other, the joints of which mark a transformation from one warp order to the next. This model does nothing to address the discontinuities in creating warp beams and the heavy costs of creeling, and rather uses the idea of batching orders for each order to cost less.

Other frameworks attempt to address the costs of creeling yarn packages, and they can be seen as a relatively direct automation of what laborers would normally do, an approximation of human movements done by a machine. One such attempt simply automates the process of yarn package placement. Instead of a laborer picking up a yarn package, placing it on the creel and tying it to the previous, emptying package, a robot does it. This method requires little labor and maintains a continuity in the warp, but has two downsides: traditional yarn packages cannot support the creel weaving of thousands of yarns because of the tension issues that arise as a result of their size, and having to move to every spot in a creel to place a new package means greater distances must be covered, which makes the process too time-intensive for short-run production. An evolution of this idea is machinery that moves a smaller amount of yarn to each creel spot instead of an entire yarn package. This allows the creel to be small enough for direct weaving to be possible. However, since the yarn loader moves from creel spot to creel spot, there is an immediate and practical limitation on both the speed at which that refilling can take place, as well as the number of yarns that can be accessed for the refilling. The first problem is the result of the distance the loader must travel and its ability to refill a creel fast enough to keep up with a weaving machine that is processing short runs. The second issue is one related to moving a plurality of yarns around a space. As the supply yarns get pulled from one creel spot to the next, the distance between their point of tension and the point at which they're held will invariably change. This will mean that at any point, many of the yarns will have slackness, which will cause major entanglements. It might be suggested that flexible tubes could keep yarns contained to their own spaces and from tangling, but this causes its own tension problems by adding infinite and unpredictable points of contact to the yarn. This functional limitation means the number of accessible yarns must be held to a minimum. A suboptimal weaving system is therefore created, for both inter-warp and intra-warp reasons.

From intra-warp considerations, a reduced availability of inventoried yarns translates into a reduction in the diversity of yarns possible in a section, which limits the extent of the patterning that can be utilized in that section. For example, if a customer wants 40 different colors within the first 100 yarns of the warp, and the inventoried yarns for that section only number into the 20's, then either the customer has to alter the order or a significant amount of operator intervention would be required to change out the yarn packages mid-process. Secondly, depending on how one warp looks compared to the one that follows it (inter-warp), it may be that there are few continuations in color from one order to the next, in which case a laborer would have to take a lot of time replacing the inventoried yarn for the next order. Therefore, a lack of yarn options actually corresponds to an increase of labor to satisfy a diversity of orders, which eliminates the primary advantage of short-run manufacturing.

SUMMARY OF THE INVENTION

In order to have a cost-effective short-run, on-demand textile manufacturing process, all of the aforementioned problems must be addressed. One cannot simply automate the usual movements of a laborer. The disclosed invention comprises two creels—one with regenerating yarn packages corresponding to every yarn in the warp and one with a large plurality of inventoried yarn. All of the yarns in each creel meet in between in a yarn extension device. The yarn extension device contains two sets of heddles. Each heddle holds a different yarn from the inventory side or the regenerating package side. The yarn is threaded through the central hole of the heddle, which in turn is held between two guides. The ends of the yarns are held in between two rollers with reciprocating combs, which turn to keep the yarns both separated and tensioned, the combination of which allows one of many yarns to be pulled up by a heddle without disturbing or tangling with other yarns. The heddles allow a yarn to be selected and separated from the group, yet at the same time be held in a very tight formation. The yarn extension device matches an inventory yarn with a regenerating package yarn. After the two are joined, the specified regenerating package rotates, accumulating the new yarn length. What this amounts to is that any inventoried yarn can be pulled to any spot in the regenerating package creel without needing any part of the inventory yarn to be brought near its intended spot in the regenerating package creel and without any of the problems or slowness that occurs with other yarn movement and refilling mechanisms. The entrance and exit of the regenerating packages are independent of each other, and therefore via the exit the yarns of the regenerating package creel can flow directly into a weaving machine. The regenerating packages are small enough for creel weaving to be possible. Also, they act as a tension reset for the yarns in the inventory creel, so size limitations are not necessary on the inventory creel (and any tension differences that arise in yarns coming from the inventory creel would result in small measuring differences, which can be fixed by either calibration or a tension resetting pre-feeder placed before the regenerating package). What follows is that if a yarn extension device enables a large plurality of yarns to be held and accessed, then that innovation should be applied to both the inventory yarn side and the regenerative package side. Matching a yarn from one side to the other can then be done in a very small space and with small movements, which enables a fast cycle time, and also ensures that no yarns are moved unless they are chosen, which means they stay tensioned and in position.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

In the following description, numerous specific details are set forth regarding the systems and methods of the disclosed subject matter and the environment in which such systems and methods may operate, etc., in order to provide a thorough understanding of the disclosed subject matter. It will be apparent to one skilled in the art, however, that the disclosed subject matter may be practiced without such specific details, and that certain features, which are well-known in the art, are not described in detail in order to avoid complication of the disclosed subject matter. In addition, it will be understood that the examples provided below are exemplary, and that it is contemplated that there are other systems and methods that are within the scope of the disclosed subject matter.

The disclosed invention proposes a novel machine and a process to manufacture textiles on-demand, continuously, and without the set-up costs, labor, or time delays of the traditional manufacturing process. This process includes a novel method of automated creeling.

It will be apparent that most current warping processes involve the creeling of hundreds to thousands of yarn packages, a laborious and/or time-consuming step that the disclosed invention bypasses by using permanently placed, regenerating packages to pull yarn onto creels instead of a laborer or machine placing entire yarn packages on creels.

A problem with traditional machines and warping processes is that they have multiple points of discontinuity between the yarn packages and the final woven fabric. The disclosed invention does not.

A problem with traditional machines and warping processes is that they have set-up costs whenever a warp is produced, which must be spread over the warp yardage. The disclosed invention has a permanent infrastructure and no set-up costs.

A problem with traditional machines and warping processes is that they necessitate the batching of yardage (or orders). The disclosed invention enables the economical on-demand manufacture of one order at a time, which is unaffected by and does not rely on the presence of any other order.

Another problem with traditional machines and warping processes is that they do not have a reliable way to hold and access one of many yarns in a space-minimizing configuration.

Instead of regular yarn packages arranged in creels that need to be replaced as they run out, either by a person or a machine, the disclosed invention proposes a regenerating yarn package that can refill itself with yarn without the need for a person or machine to replace the entire package. It is much easier to transport yarn (by accumulating it) than it is to transport yarn packages, which are heavy, large, and require nontrivial amounts of time to place by any method. It is also advantageous to transport yarn by its own accumulation instead of by a separate transportation mechanism.

Figure 18A:
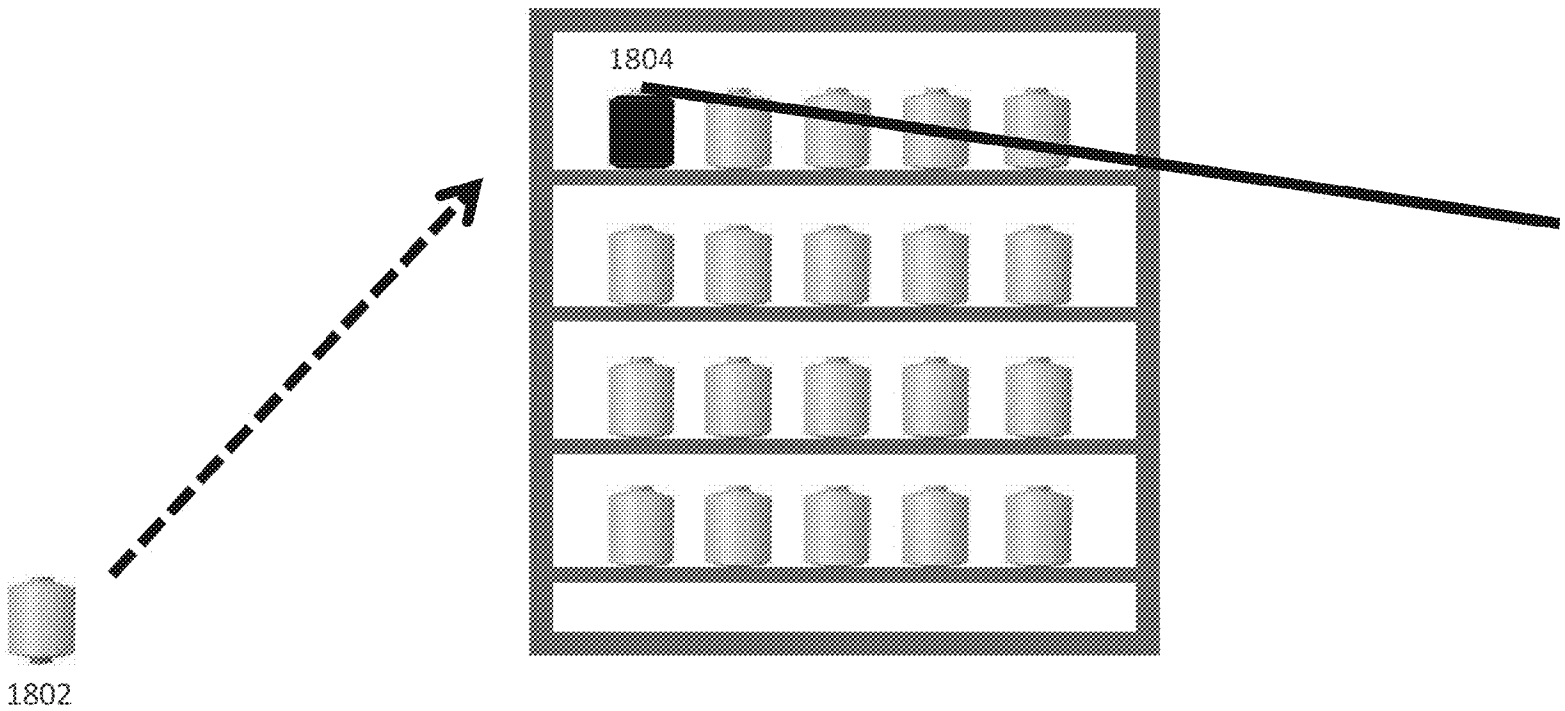
FIG. 18A PRIOR ART
FIGS. 18A-C illustrate the transportation of a yarn package as a way to replenish a warp.
Figure 18B:
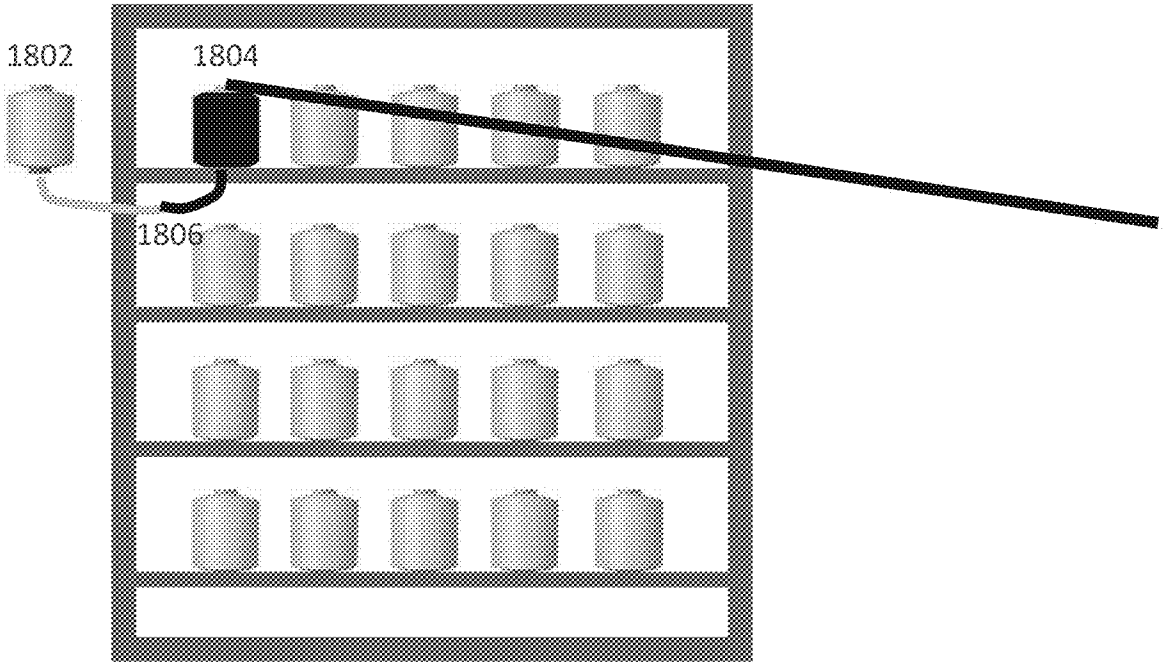
FIG. 18B PRIOR ART
Figure 18C:
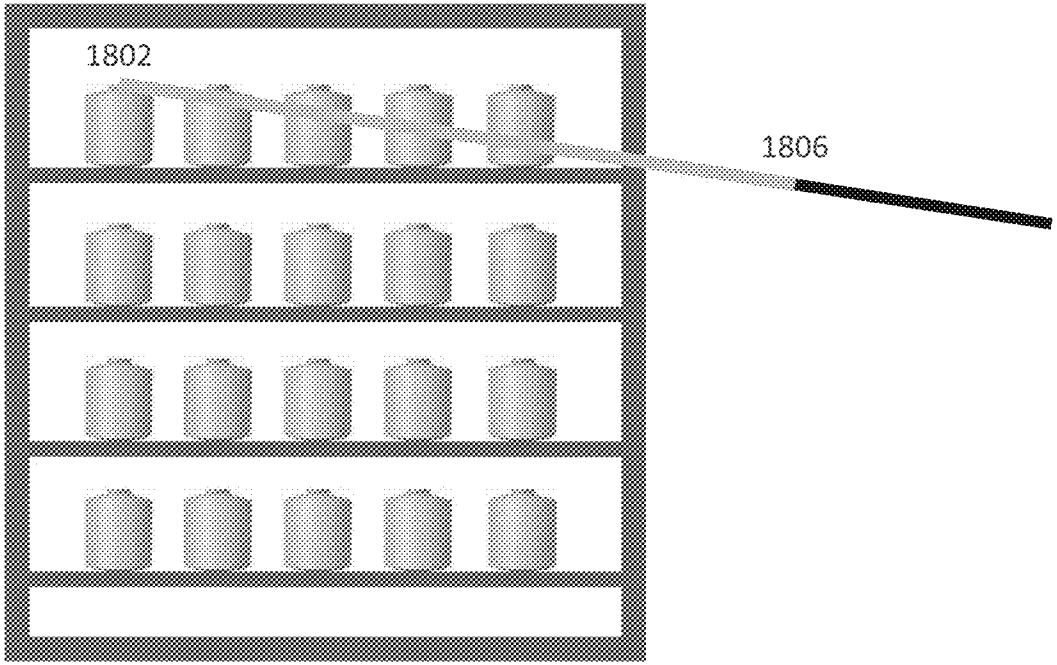
FIG. 18C PRIOR ART

As illustrated in FIGS. 18A-C, traditional machines and warping processes, when yarn package A (1804) is exhausted on its creel, require a laborer or a machine to pick up (FIG. 18A) a new yarn package B (1802), place it on or near the bullhorn where package A was, and connect the distal ends (FIG. 18B) of package A and B (1806). Package B is then pulled into the warp (FIG. 18C).

Figure 19A:
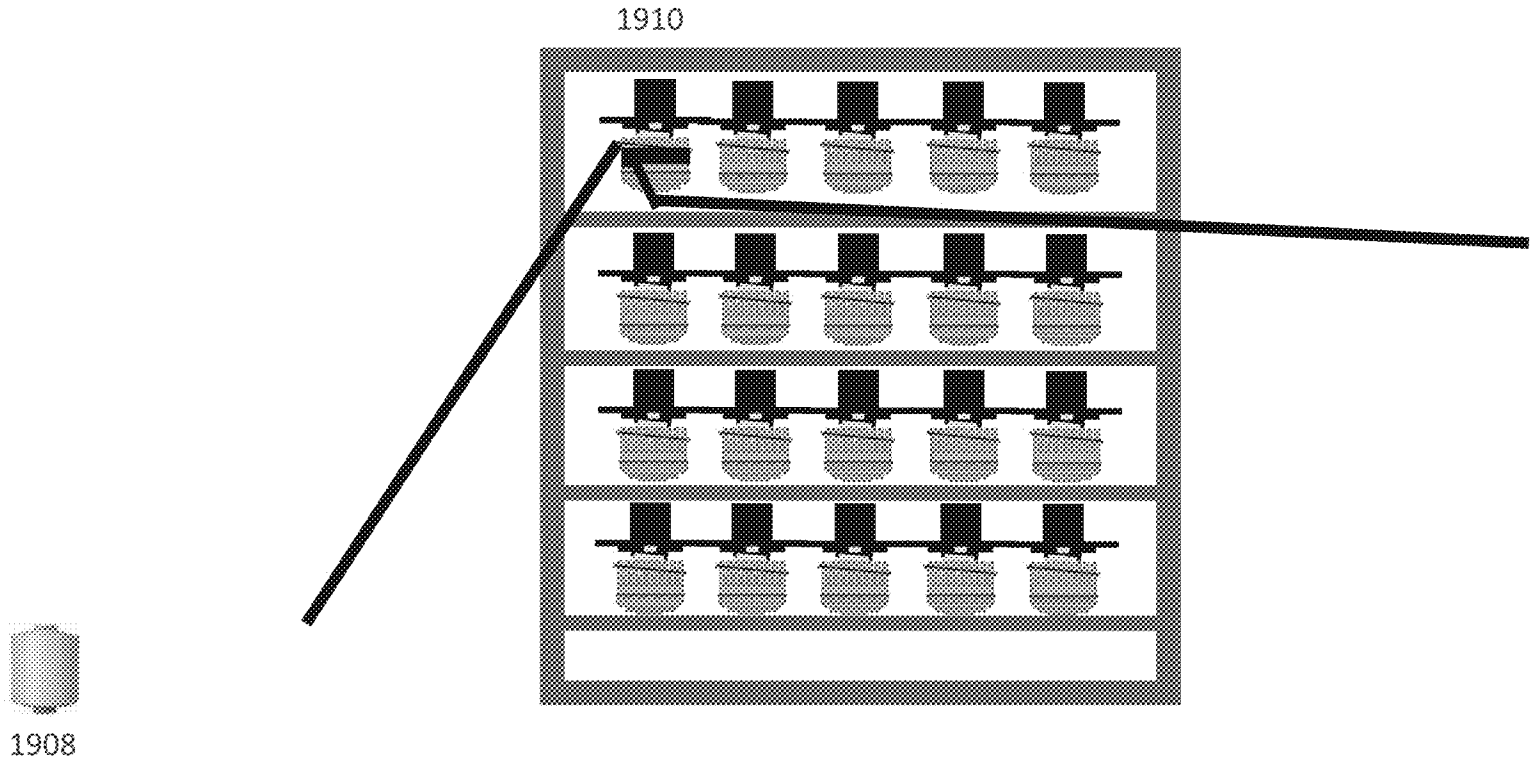
FIGS. 19A-C illustrate the transportation of yarn as a way to replenish a warp in accordance with an embodiment of the invention.
Figure 19B:
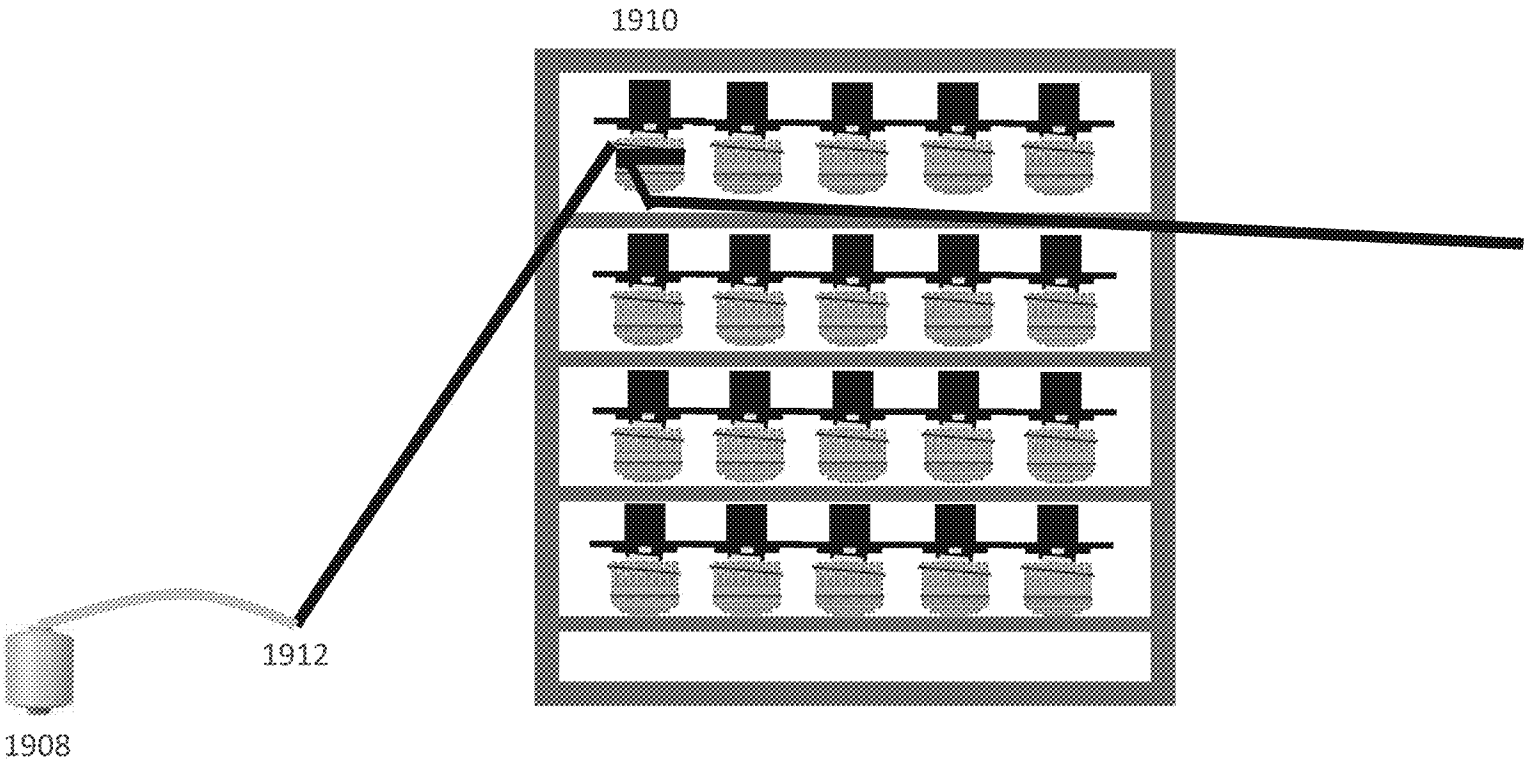
Figure 19C:
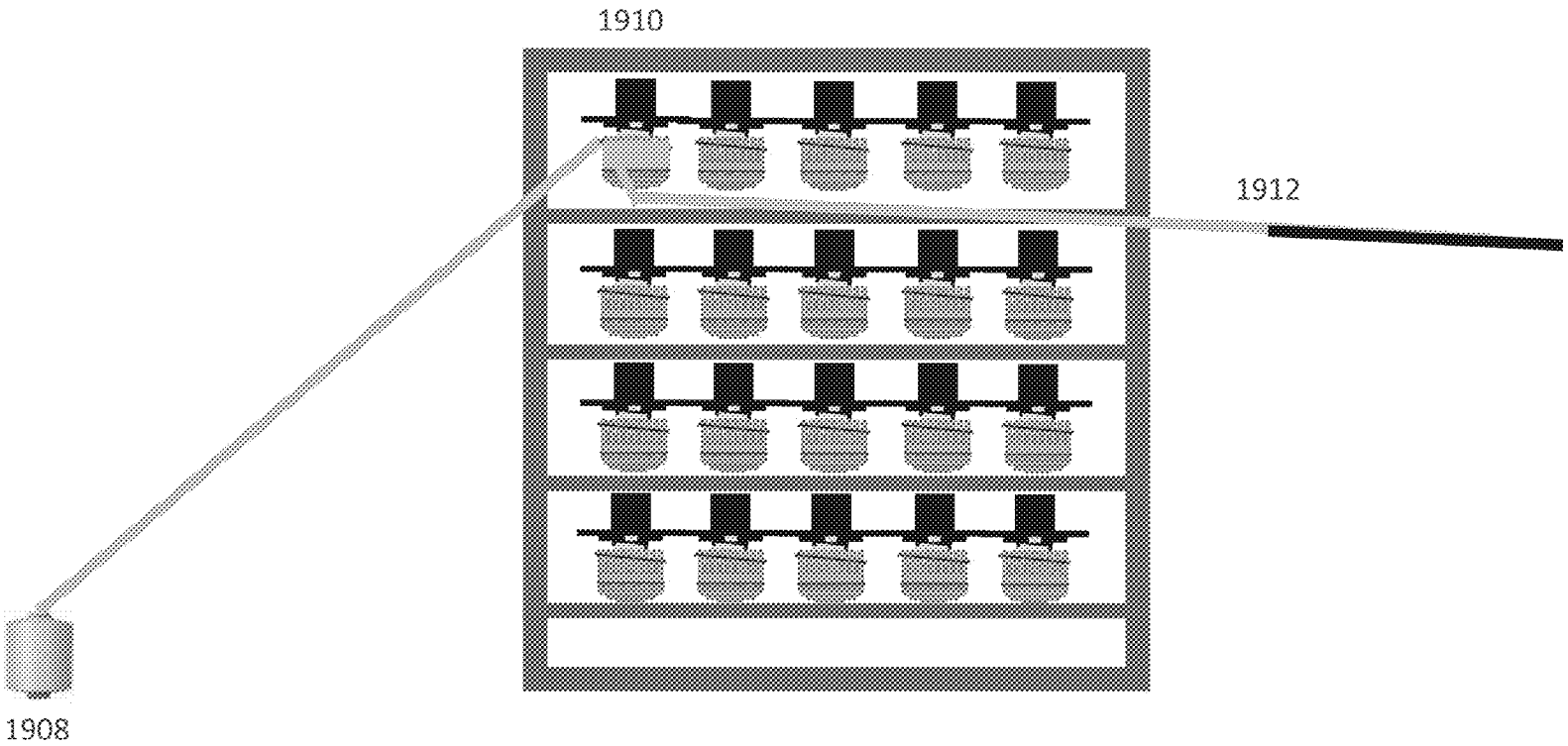

The disclosed invention suggests another method (FIG. 19A) of getting yarn from a package B (1908) onto a yarn package A (1910), which is by first making the connection of the yarn ends (FIG. 19B) of yarn packages A and B (1912), and then by rotating the package A so that it accumulates the yarn from the package B (FIG. 19C).

With this idea in mind—that of replenishing yarn on a creel by transporting yarn without transporting a yarn package, and using a yarn's accumulation as a means for its own transportation instead of a separate transport mechanism—the disclosed invention makes possible a faster and more economical creeling process, in addition to one that changes the entire process and possibilities of textile manufacturing.

A creel of regenerating yarn packages provides the infrastructure for the disclosed invention. In other words, instead of thousands of yarn packages on a creel used for a warp, the disclosed system uses thousands of regenerating yarn packages for that warp. The regenerating yarn packages are the infrastructure of the warp and do not need to be replaced. When more yarn is needed, each is connected to a chosen yarn, which can then be accumulated, effectively replenishing the yarn supply available to the warp.

Figure 17:
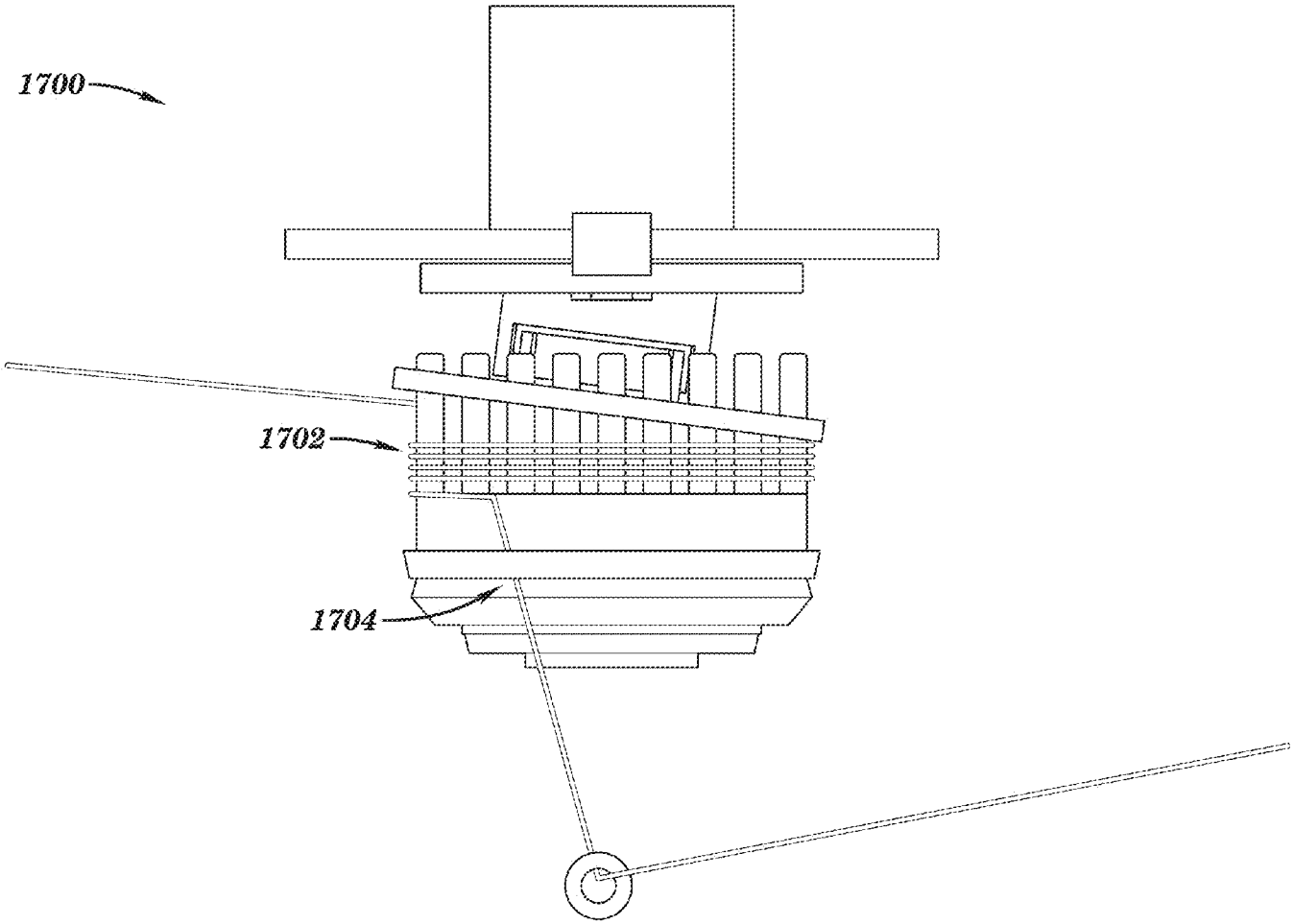
FIG. 17 illustrates a "Regenerating Yarn Package" in accordance with an embodiment of the invention.

The regenerating yarn packages of the disclosed invention have three key features (FIG. 17, reference 1700). The first key feature is that the regenerating yarn packages can accumulate yarn and release yarn. Secondly, the entrance on the regenerating packages where the yarn is accumulated (1702) and the exit where the yarn is released (1704) may operate independently of one another. In other words, yarn can be accumulated through the entrance at a certain rate while the other side of the yarn can be released through the exit at the same or different rate of the accumulation. A natural advantage of having an independent entrance and exit is that it acts as a tension reset for yarn. In other words, yarn may enter at a varying tension, but leaves with the tension reset to a specific tension regardless of the entrance tension. Thirdly, a measured amount of yarn can be accumulated by the regenerating packages. The combination of these features enables the regenerating yarn packages to summon lengths of yarn from an inventoried source and replenish themselves while yarn is being released to a weaving machine. This is in contrast to the traditional method of automated creeling, in which an entire yarn package must be placed near the bullhorn of the emptying package in order to replace it.

Figure 1:
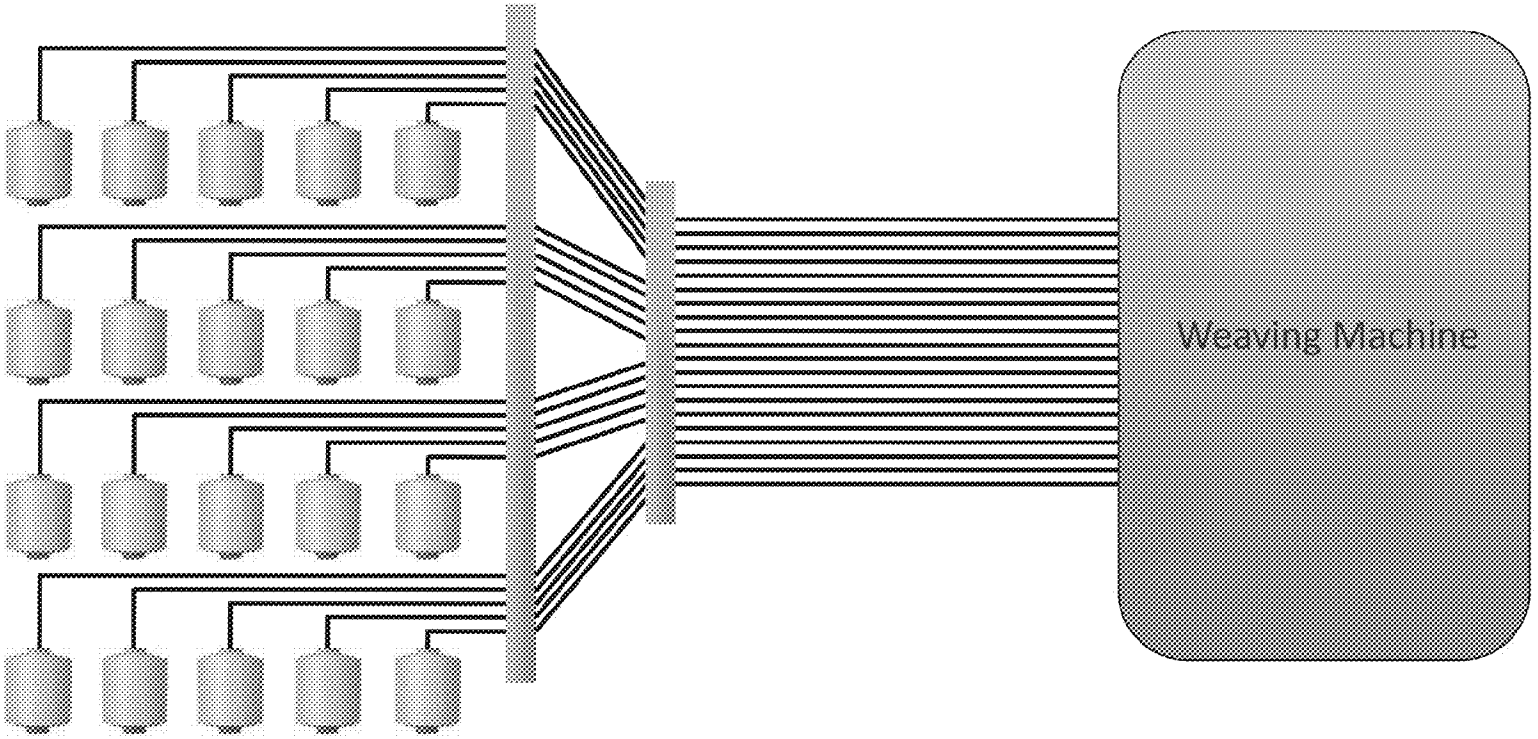
FIG. 1 PRIOR ART
FIG. 1 illustrates a direct weaving set-up.
Figure 2:
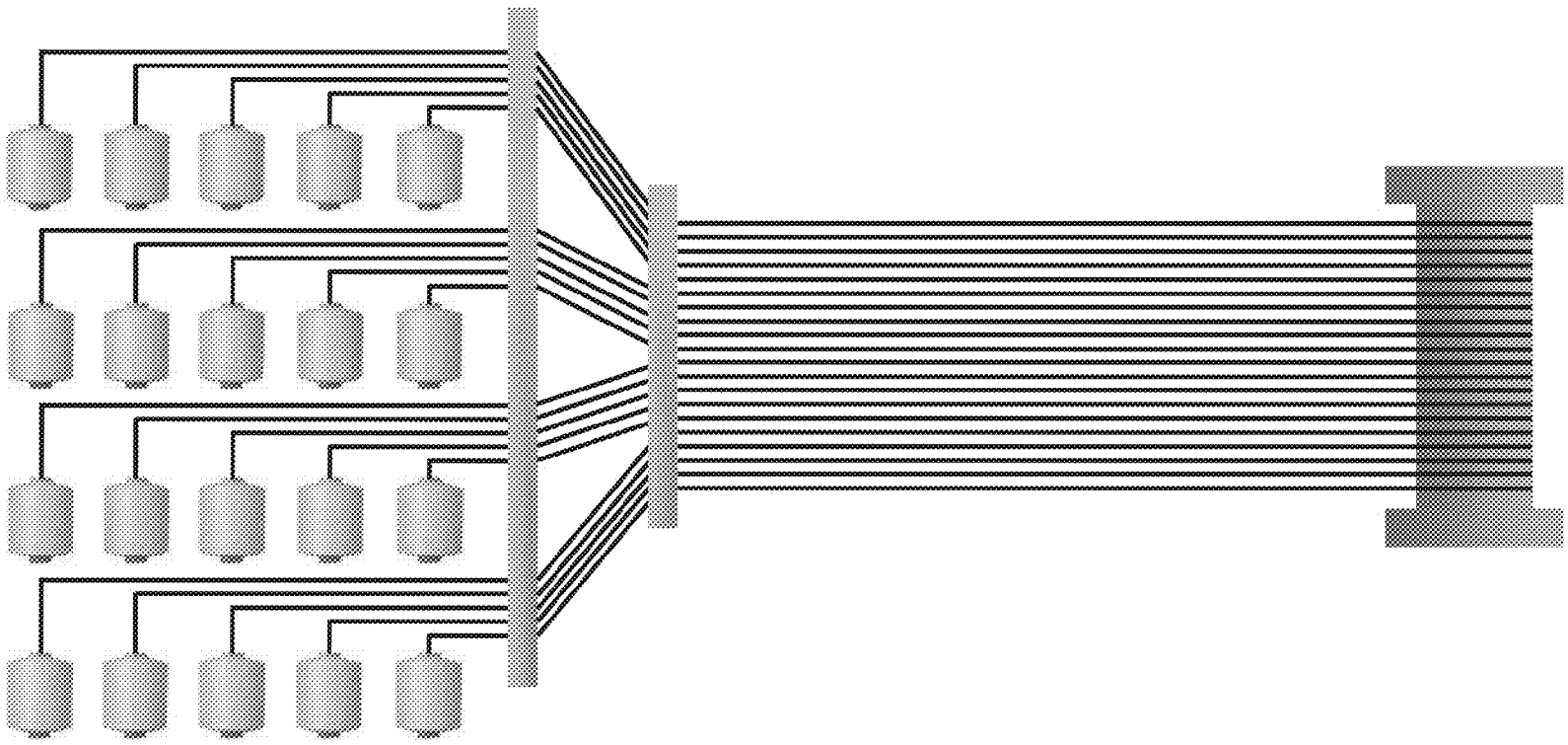
FIG. 2 PRIOR ART
FIG. 2 illustrates a direct beaming set-up.
Figure 3:
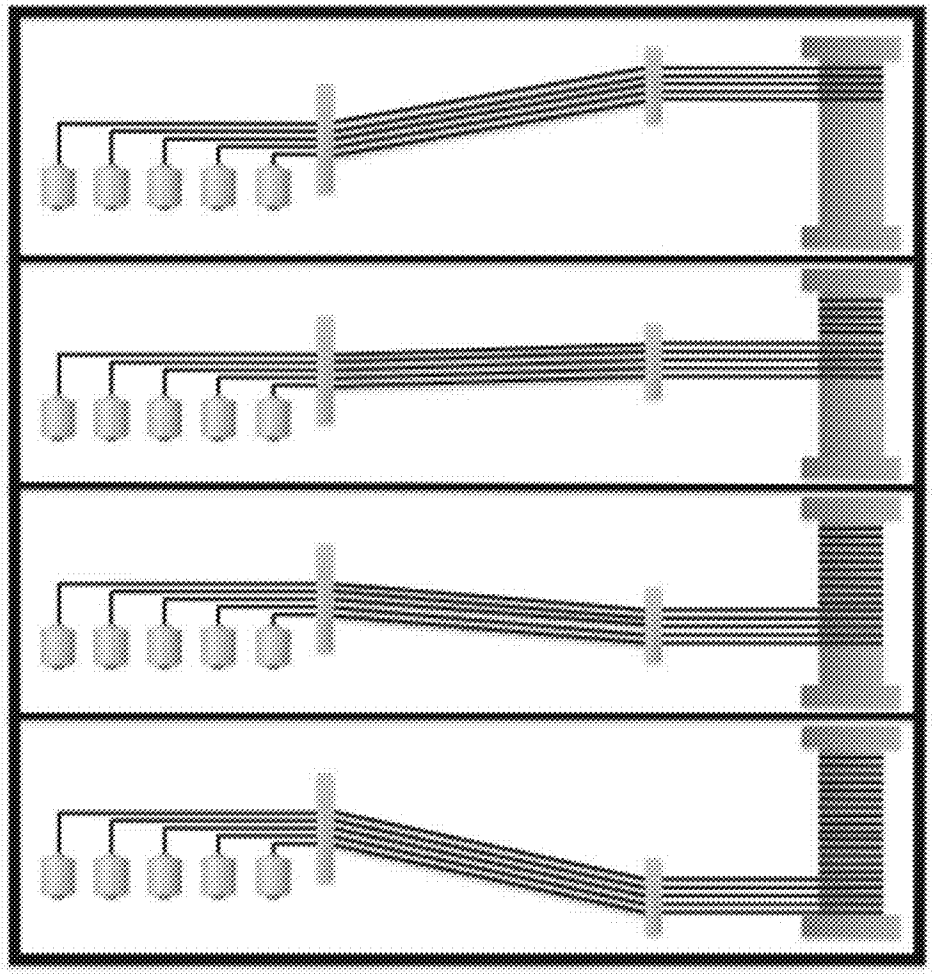
FIG. 3 PRIOR ART
FIG. 3 illustrates a sectional warping set-up.
Figure 4:
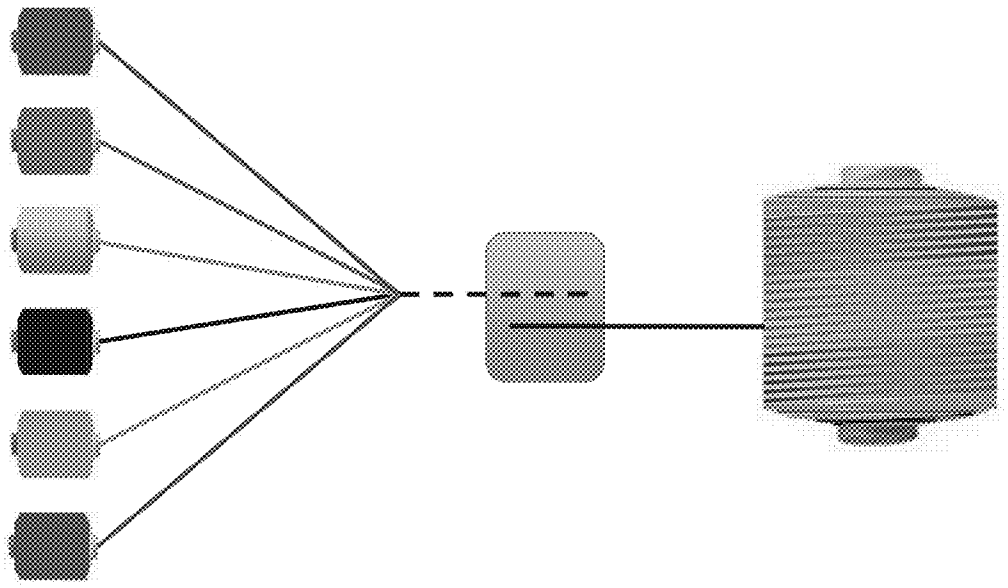
FIG. 4 PRIOR ART
FIG. 4 illustrates a textile machine and process to make yarn packages.
Figure 5:
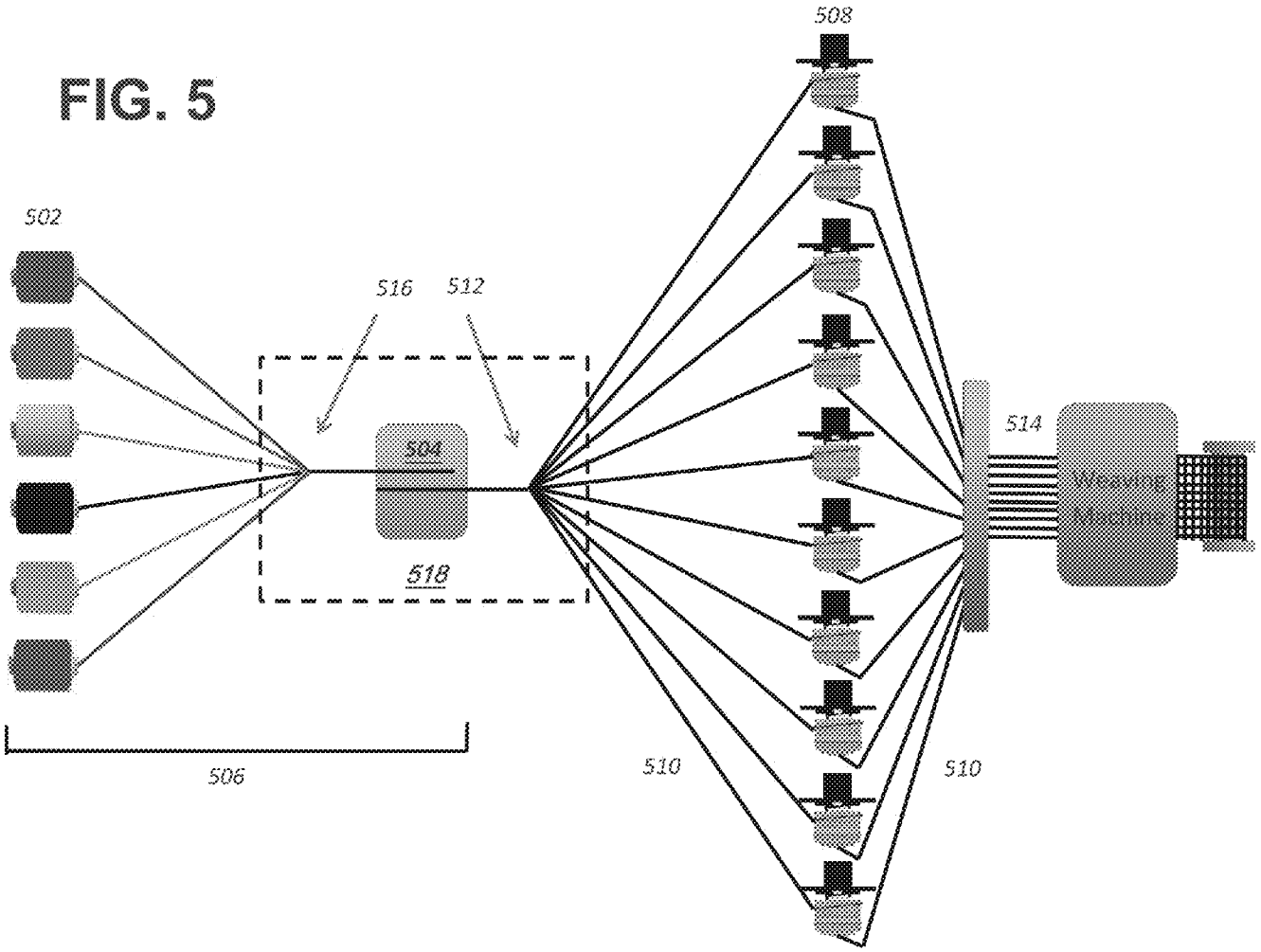
FIGS. 5 and 5A illustrate a textile machine and process in accordance with an embodiment of the invention.

Regenerating yarn package 508 (FIG. 5) can be any suitable device or modification of such device. For example, existing devices on the market can be modified to act as one of these special regenerating packages. In one embodiment, a knitting accumulator or a weft feeder, both of which accomplish the first two features, can have their motors replaced with more accountable motors (e.g., stepper motors or servos or geared-up DC motors) to accurately meter all rotational movement, which drives the accumulation of yarn. The reason these devices can be used to accurately accumulate yarn is because they accumulate yarn in a way that does not cause it to overlap or build on itself. If it overlaps or builds on itself, the circumference of the circle on which the yarn is wrapping changes, which means every rotation of the motor pulls in a different, increasing amount of yarn. These accumulators transport yarn while it is pulled in (whether by a ring or slope that pushes the yarn down, or a peristalsis that pushes accumulated yarn forward) so that the circumference at the wrapping point always remains the same. With a constant circumference, every rotation of the motor pulls in a consistent amount or length of yarn. In some implementations, other accumulators may be used in place of the ones described, provided they can be used to accumulate yarn onto the regenerating yarn packages as described herein.

For the purposes of explanation but not limitation, one proposed set-up of the system can be seen as a mirror—a yarn extension device in the middle, and on each side yarn packages held in creels. On one side, however, the yarn packages are normal, colored yarn packages being inventoried, and on the other side, the yarn packages are special regenerating yarn packages.

The inventory side of the system is referred to as such because its yarns replenish the yarns in the regenerating yarn packages.

The inventory side of the system has yarn packages (502). The yarn packages can be any suitable package and can be of different colors, thicknesses, materials, or any suitable combination thereof. They are all held in a configuration that allows them to be grabbed, lifted, or accessed by the yarn extension device. Any suitable machinery and/or process can be used to accomplish this. For example, in one embodiment, all of the yarns can be held separately and a grabber can select a yarn. In another embodiment, all of the yarns can be threaded through heddles and held in tight density as with a jacquard weaving machine, with the chosen yarn lifted by its heddle, thereby separating it from the group, which then allows it to be grabbed.

Sitting next to the accessible inventory of yarns is a yarn extension device (518). The yarn extension device connects yarn from one of many yarn packages (502) with yarn from one of the many regenerating packages (508) using a yarn joiner (504). In one embodiment, the yarn joiner can be a knotter, which ties (i.e., knots) two pieces of yarn together. In another embodiment, the yarn joiner can be a splicer, which twists two pieces of yarn together. In yet another embodiment, the yarn joiner can be a wrap splicer, which wraps a third piece of yarn around the ends of the two chosen pieces of yarn to join them. Any suitable yarn joiner can be used that takes two pieces of yarn and joins them into a continuous strand.

Figure 23A:
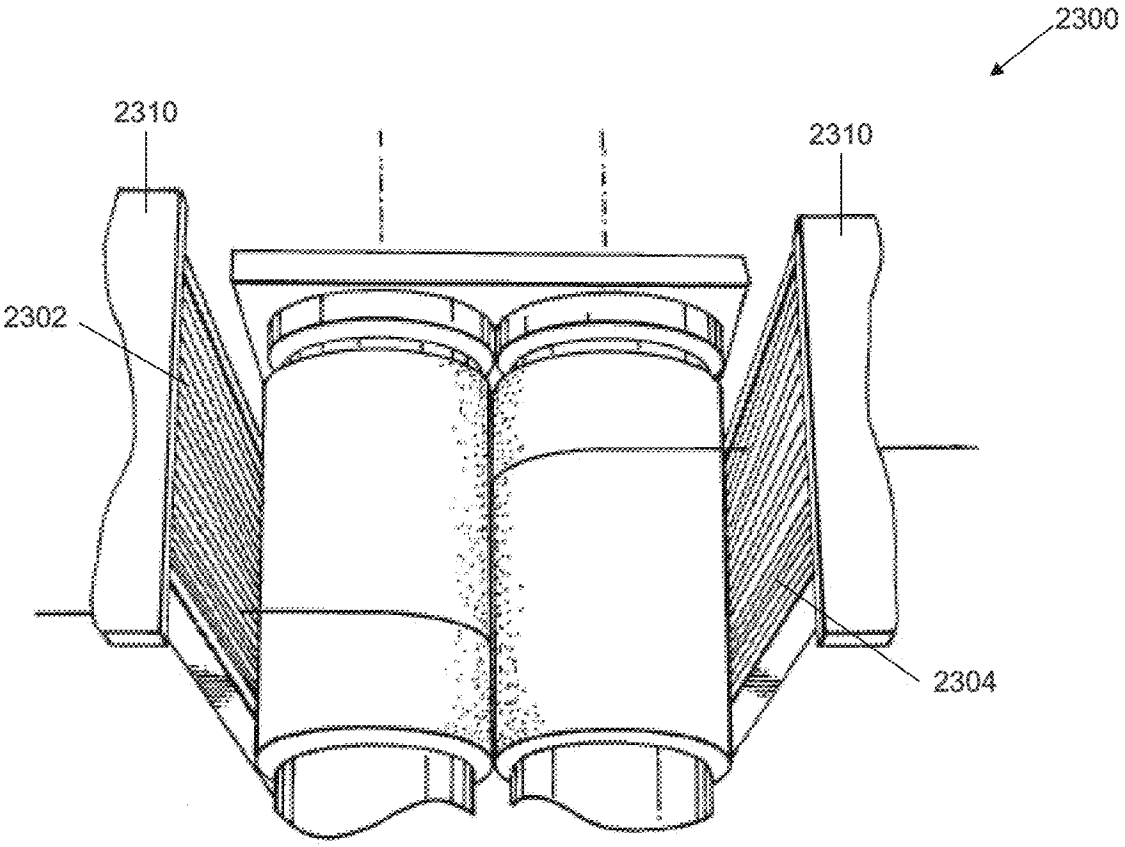
FIGS. 23A-E illustrate a yarn extension device operating to select, join, and accumulate yarn in accordance with an embodiment of the invention.

FIG. 23A illustrates one implementation of a yarn extension device 2300 for selecting and joining yarns as described herein. For clarity, the hundreds of yarns held on each side of the device 2300 are not shown other than a single thread on each side. Yarns are individually selected by means of a first set of heddles 2302 on the inventory side and a second set of heddles 2304 located on the regenerating package side. Each heddle 2302, 2304 holds a different thread of yarn representing a different inventory package or regenerating package. In this way, the set of threads corresponding to each of the inventory packages, and the set of threads corresponding to each of the regenerative yarn packages are held on opposite sides of the device 2300 for joining.

Traditionally designed for the purpose of weaving, heddles are made very long, thin, and light, and are therefore flexible. They are held loosely at their ends by elastic, rendering them prone to shifting position and bending. This prior art configuration is suitable for the slow, straight passing of yarn typical of the weaving machine itself, but as knots and changes in yarn direction have a tendency to pull heddles into other heddles and create entanglements, it is not suitable for the joining and accumulation process taught herein. Instead, as shown, each heddle 2302, 2304 is inserted in a slot between two guides 2310 (only the upper guide 2310 is shown). There is sufficient distance between the upper and lower guides 2310 for the heddle to be moved up and down as further described below. However, a much smaller amount of heddle is exposed to movement in this configuration, and consequently the heddles 2302, 2304 move and flex less than in a conventional configuration. This results in the heddles being able to hold a thread that moves quickly between the two heddles during thread accumulation without the thread breaking or tangling with other threads, and without a knot in the thread being able to drag a heddle out of place, which, among other issues, could cause yarn breakage.

Figure 23B:
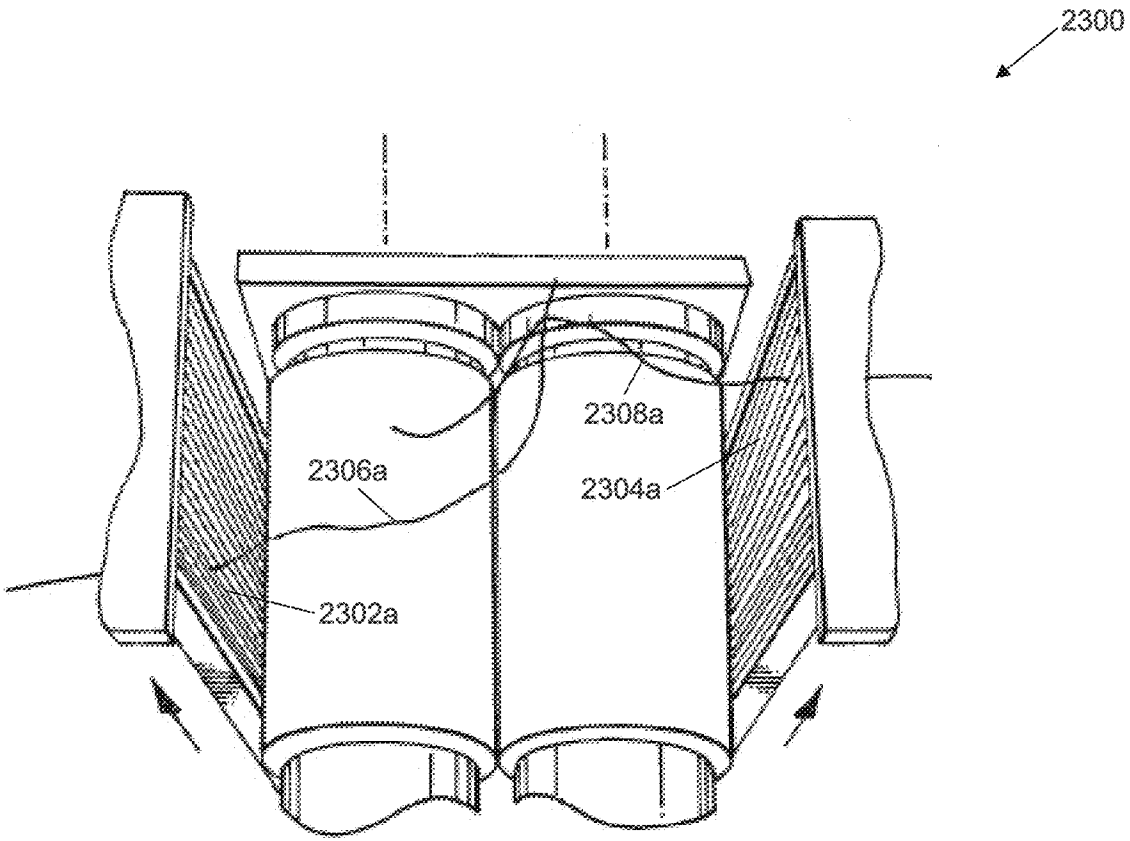

As shown in FIG. 23B, when two threads need to be joined, a specific heddle 2302 is selected and made to move upward, which pulls a corresponding thread 2306*a* away from the other threads held by the other heddles 2302 on the inventory side. Similarly, a selected heddle 2304*a* is also moved upward, separating the corresponding regenerative package thread 2308*a* from the other threads on the regenerating yarn package side.

As illustrated in FIG. 23, any one of the threads 2304 may be joined with any one of the threads 2308 by means of this device 2300. This provides substantial flexibility in the colors available for manufacturing without any additional changes being made manually to the system. It also allows the warp threads to be accessed independent of their actual spots in the creel, where distances between threads are greatly increased.

Figure 23D:
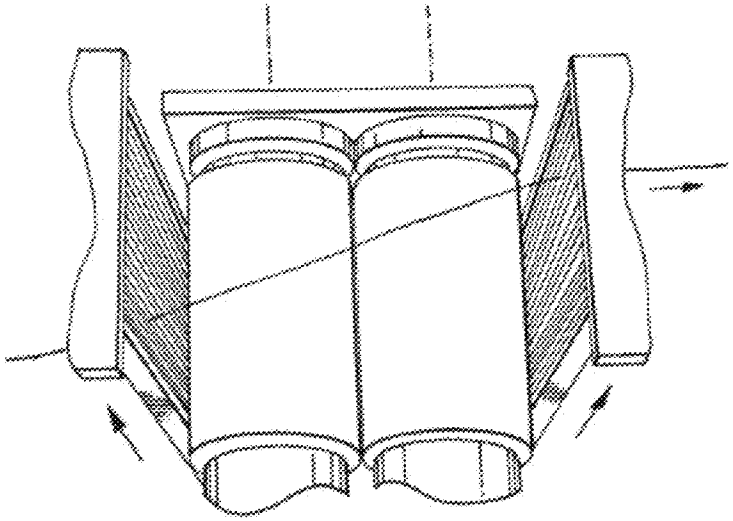
Figure 23C:
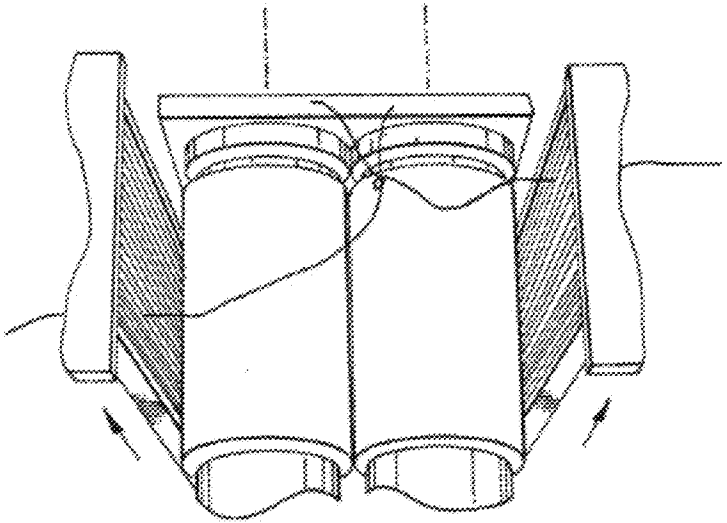

The selected threads are joined as described above by means of a knotter or other thread-joining apparatus as known in the art (FIG. 23C), and the necessary amount of thread is pulled through the heddles 2302*a*, 2306*a* and onto the regenerative package corresponding to the thread 2306*a* (FIG. 23D). At this point the joined thread may be cut so that the threads 2306*a* and 2308*a* are again distinct, although in some implementations the thread may not be cut until one or another of the two joined thread ends 2306*a*, 2308*a* are selected again for further joining (that is, any thread-cutting may occur above when each thread end is first grabbed). By not having to cut the threads, time is shaved off of each cycle. Not only that, but less equipment is needed to ensure the proper return of the yarn when the pieces are connected and not prone to snapping in any direction. The steps described below with respect to the rollers may, in some implementations of the invention, be carried out on threads that are still joined.

Figure 23E:
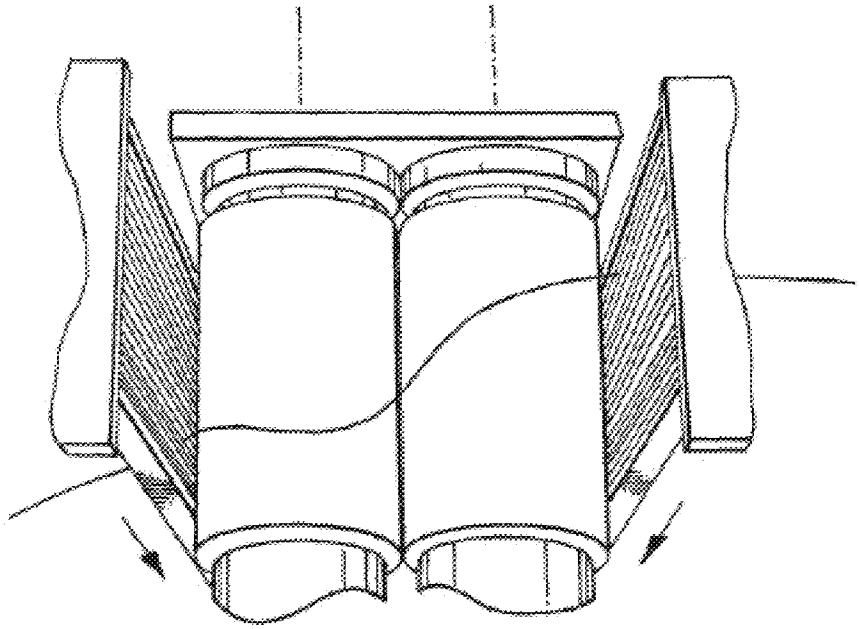

Once the appropriate amount of thread has been collected by the regenerative package, the device 2300 resets to allow for the next selection of threads for joining and accumulation. The selected heddles 2302*a*, 2304*a* are lowered into position with the other heddles 2302, 2304 (FIG. 23E). The rollers 2320 are then activated to move the selected threads back into position with the other threads, as further described below.

Figure 24B:
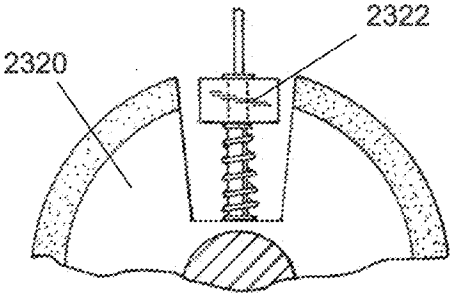
FIGS. 24B-C are cross-sectional views of a roller with a reciprocating comb in accordance with an embodiment of the invention.
Figure 24C:
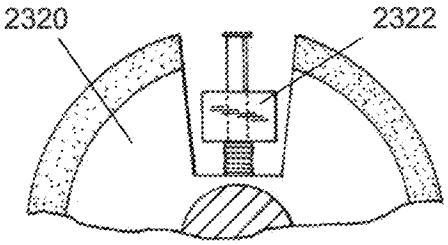
Figure 24A:
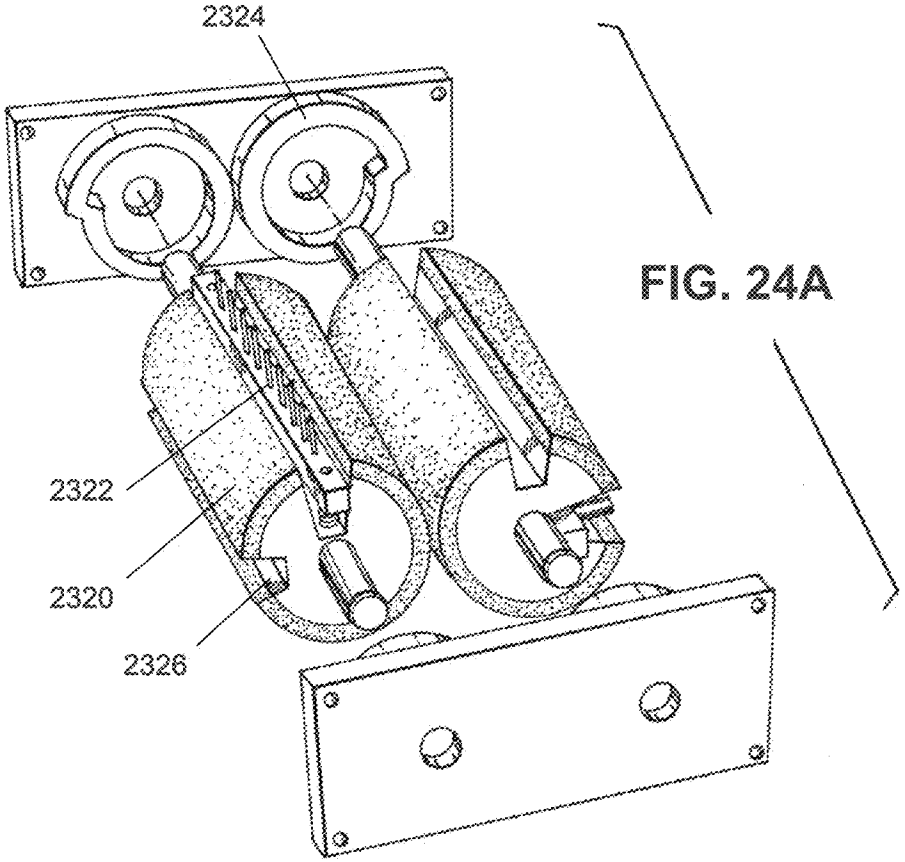
FIG. 24A is an exploded perspective view of a yarn extension device in accordance with an embodiment of the invention.
Figure 25B:
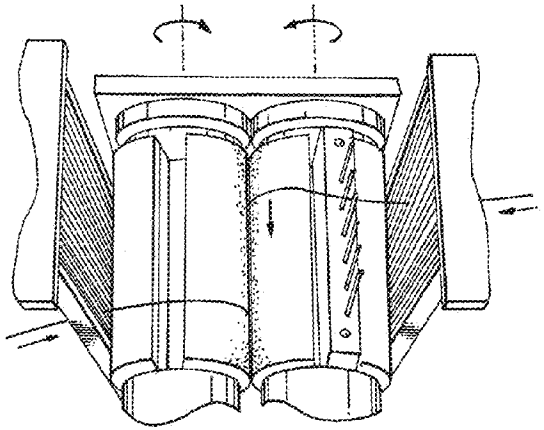
FIGS. 25A-C illustrate a yarn extension device operating to recapture loose threads in accordance with an embodiment of the invention.
Figure 25C:
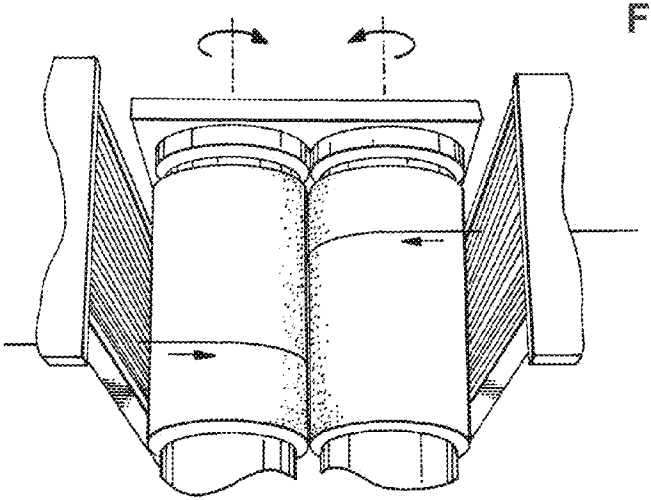
Figure 25A:
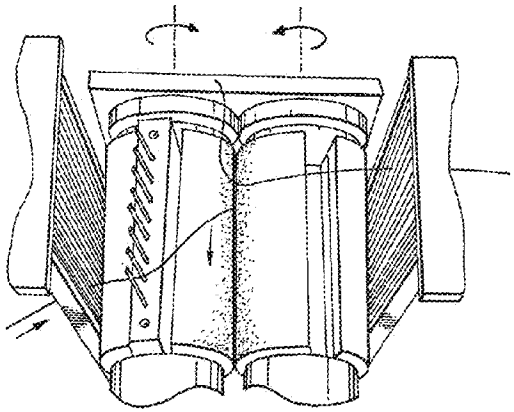

As shown in FIGS. 24A-C, each roller 2320 includes a reciprocating comb 2322 which, when the roller 2320 rotates, moves along the set of threads from the point where they emerge from the heddles 2302, 2304 to the center of the device 2300 where the rollers 2320 meet. FIGS. 24A-C further show that each comb 2322 may retract into the roller 2320 during some portion of the rotating cycles, as directed by a roller guide 2324. Each roller may also include a recess 2326 to receive the comb 2322 of the opposite roller 2320, and the rollers may be rotationally positioned to operate such that each comb 2322 meet a corresponding recess 2326 as it arrives at center where the rollers 2320 meet. In some implementations, the roller combs may not retract. It has been determined that a retracting comb has the advantage of dislodging any thread which might otherwise have become entangled with the comb and pulled too far by the further motion of the rollers.

By combing in this direction, the comb 2322 repositions any out-of-place threads to lie in order along the roller 2320 thus preventing tangles. The movement of the rollers 2320 also places the current end of the threads (or, in the case of threads that have previously been joined and not yet cut, a small amount of slack in the thread) between the two rollers 2320 below the plane in which the heddles 2302, 2304 operate. In this way, each thread is in a position where it can be easily lifted for joining without being tangled with and accidentally lifting another, unintended thread or any disruption to the unselected threads. This prevents the problematic situation where an unselected thread, if allowed to be left un-tensioned or crossing other threads, might accidentally be pulled up with the selected thread.

The above device 2300 represents one novel method keeping the threads distinct and untangled for use in a many-to-many joiner 504 as herein described. With many yarns in such a small space, it's important for them to remain untangled (and tensioned, or a loose strand could accidentally be pulled up with the chosen strand), otherwise accessing a single yarn becomes precarious and unreliable. With this device, all the yarns are combed and tensioned after each use, effectively pulling them into a tight, straight line directly from their heddle. This action allows them to space themselves out to their original positions. Other methods that involve using physical separations like tubes, or rotating wheels, quickly hit the upper limit on the number of yarns they can hold before the holding bay becomes prohibitively large. And the larger the holding and access point for the yarns, the fewer yarns one can inventory. Furthermore, an important aspect of this invention is the speed at which yarns can be accessed and connected, as filling out a single warp requires thousands of connections. The speed of that grab and connection is very important for the economics of the process, and the larger the movements made, the less efficient the system. Therefore, being able to configure the yarns, both from the inventory side and the creel side, in a very dense yet accessible and untangled set-up is crucial to making the system useful for on-demand, labor-free, short-run manufacture.

These inventoried yarns and their access point (502 and 516), as well as the yarn joining device (504) are collectively referenced as 506.

To the opposite side of the yarn joining device (504) is a set of special regenerating yarn packages (508) held in a creel. Each regenerating yarn package corresponds with one warp yarn (510). In other words, if the desired warp set-up is 3000 yarns in width, then 3000 regenerating packages are needed to service that width, as each services one specific warp yarn (e.g., regenerating package 648 will always provide the yarn for warp yarn 648).

The yarns that enter the creel of regenerating yarn packages have one end held for access (512), just as with the inventoried yarn (516). Whatever the method, a single yarn from the group must be able to be positioned to be separated from the rest.

The purpose of the machine is to build up yarn lengths on the regenerating yarn packages, from which the yarns can exit and flow directly into a weaving machine (514). This does not limit the possibilities of what can be between the regenerating yarn packages and a weaving machine. There will likely need to be guiding eyelets, tensioning devices and nip rollers that channel and tension the yarn properly and continuously for weaving. Sizing machinery, used to coat yarn (which is necessary for single-ply yarn but not for two-ply) for weaving, can be put in this in between space if desired. In some implementations, an overfeeder and tensioning device may be disposed between the regenerative yarn packages and the weaving machine in order to accommodate slack and to retension the yarn immediately prior to weaving.

Figure 5A:
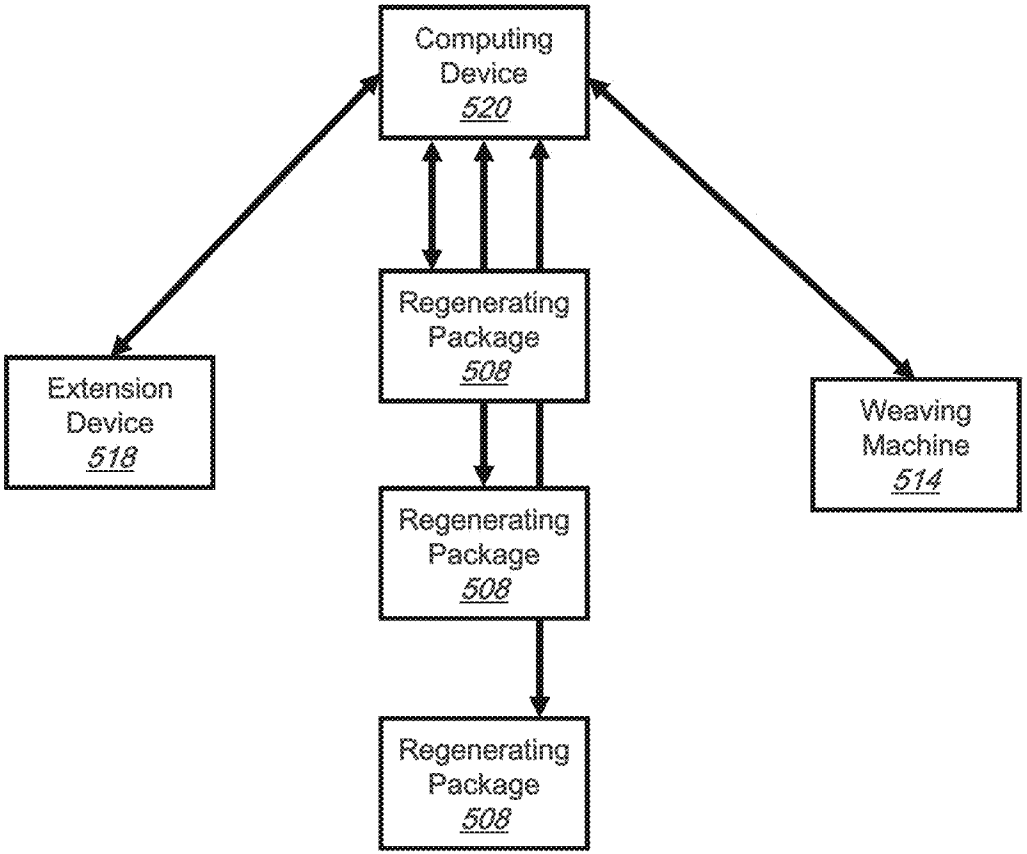

In some implementations, a computer with special-purpose software can be configured to monitor and control this process. The computer knows which inventoried yarn to couple to which regenerating package based on the warp design that is input. The information input can be from a fabric pattern designed in a software program, on an internet template, or manually input. As shown in FIG. 5A, a computing device 520 may be in communication with the yarn joining device 504, each of the regenerating packages 508, and the weaving machine 514. One of ordinary skill will recognize that the computing device 520 may have direct control of one or more elements such as a motor or other actuator. Additionally, the computing device 520 may communicate with a local controller, processor, or other circuitry associated with one or more of the devices, which in turn may control the actuating components.

Figure 6:
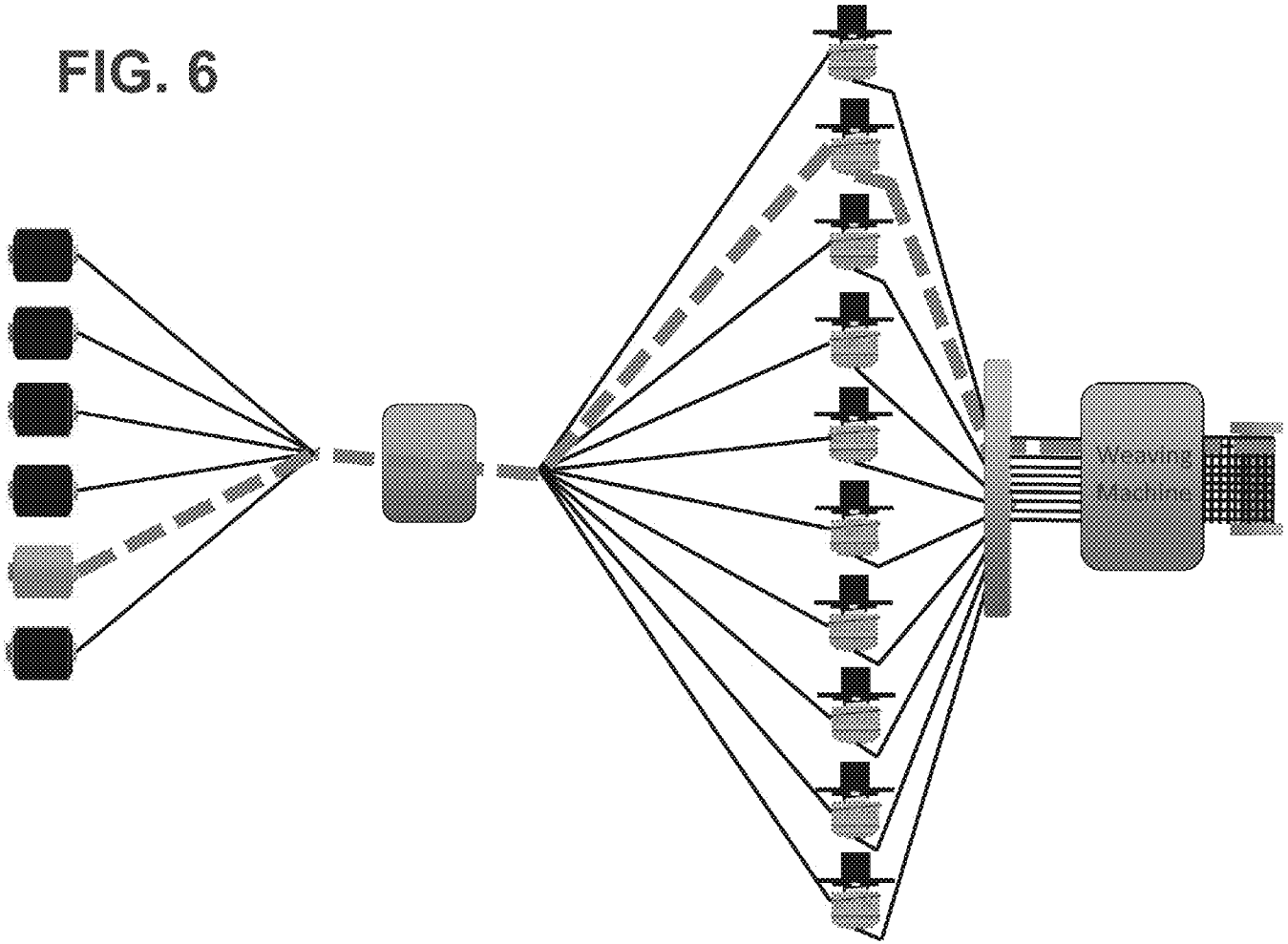
FIG. 6 illustrates a textile machine having a continuous flow of yarn from a yarn package to a weaving machine in accordance with an embodiment of the invention.
Figure 7A:
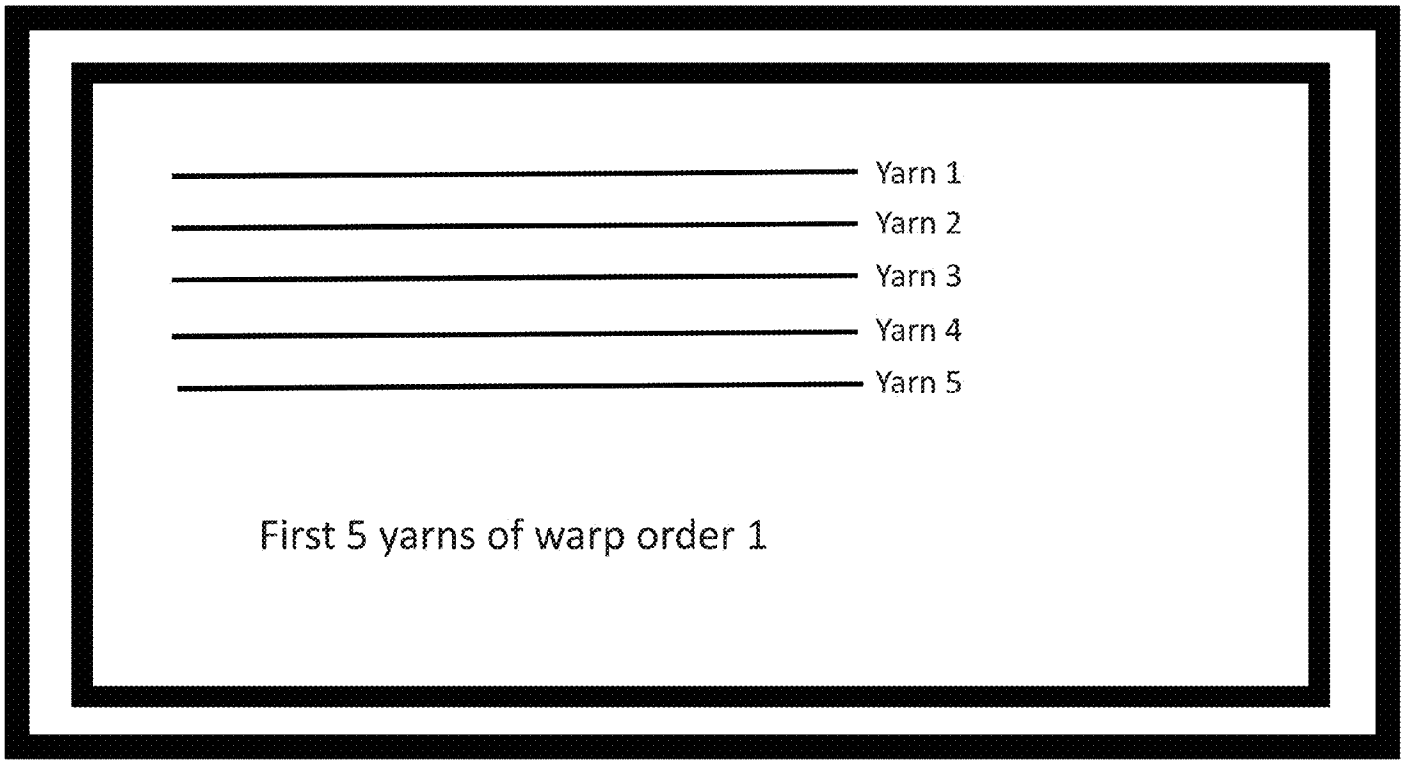
FIGS. 7A-G illustrate the cross-stream assembly of a warp in accordance with an embodiment of the invention.
Figure 7B:
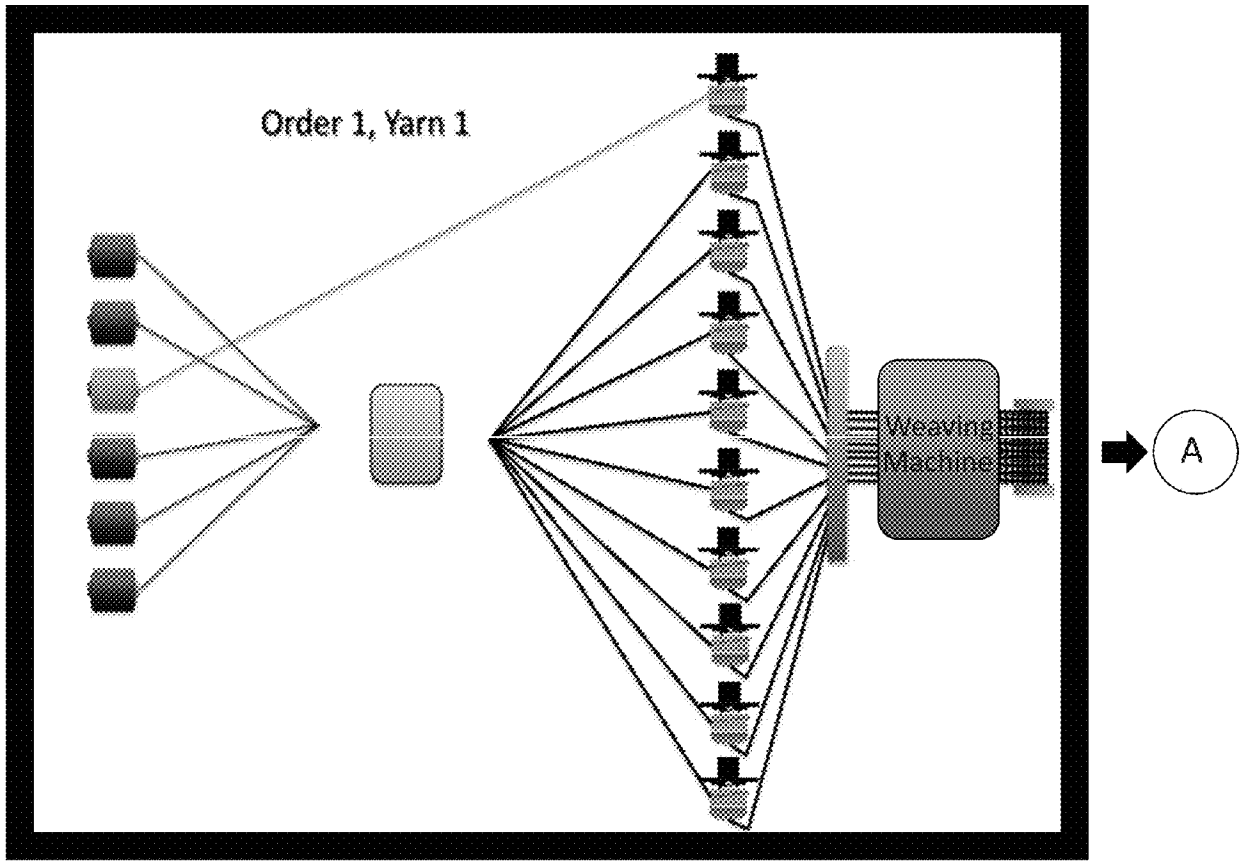
Figure 7C:
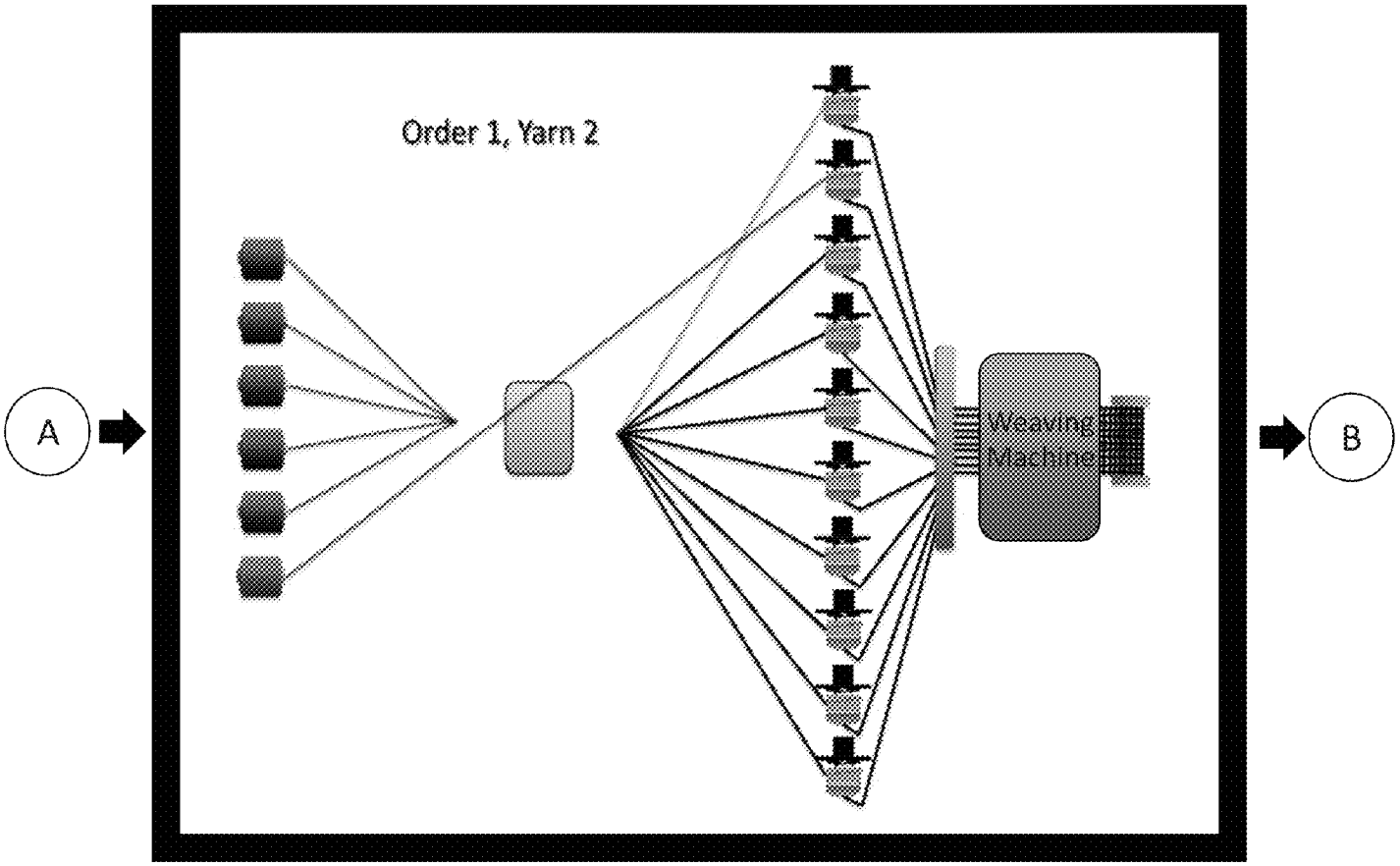
Figure 7D:
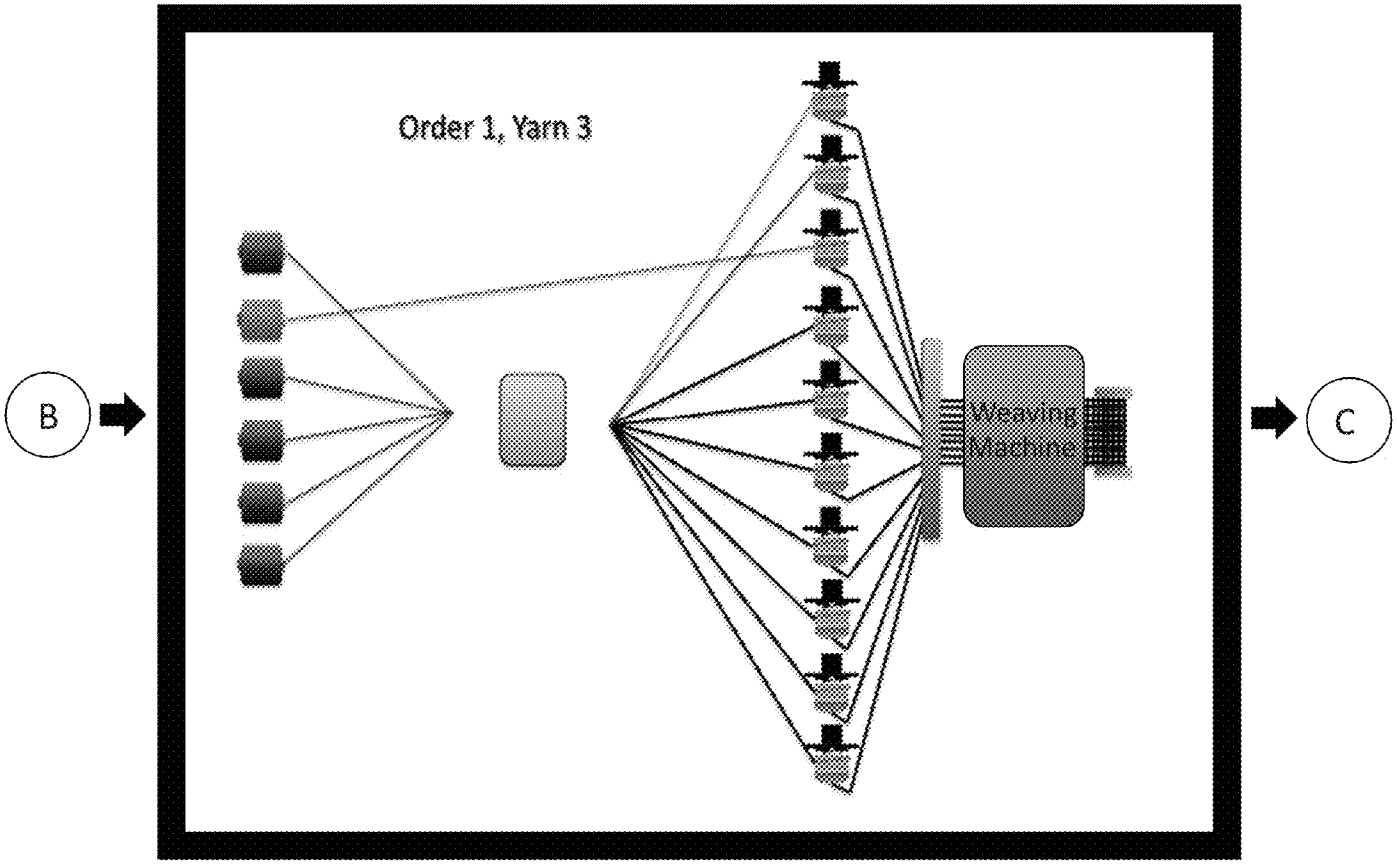
Figure 7E:
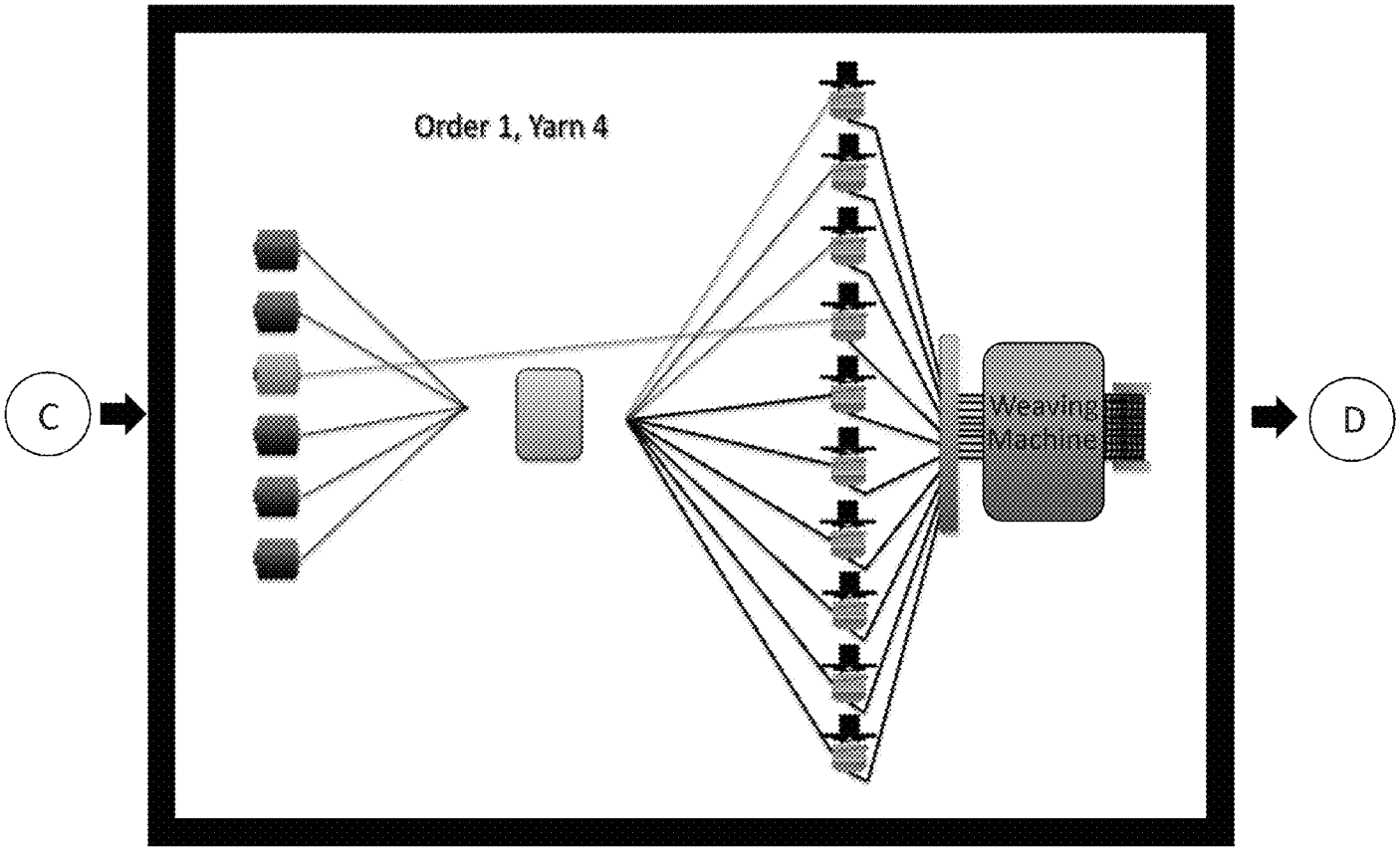
Figure 7F:
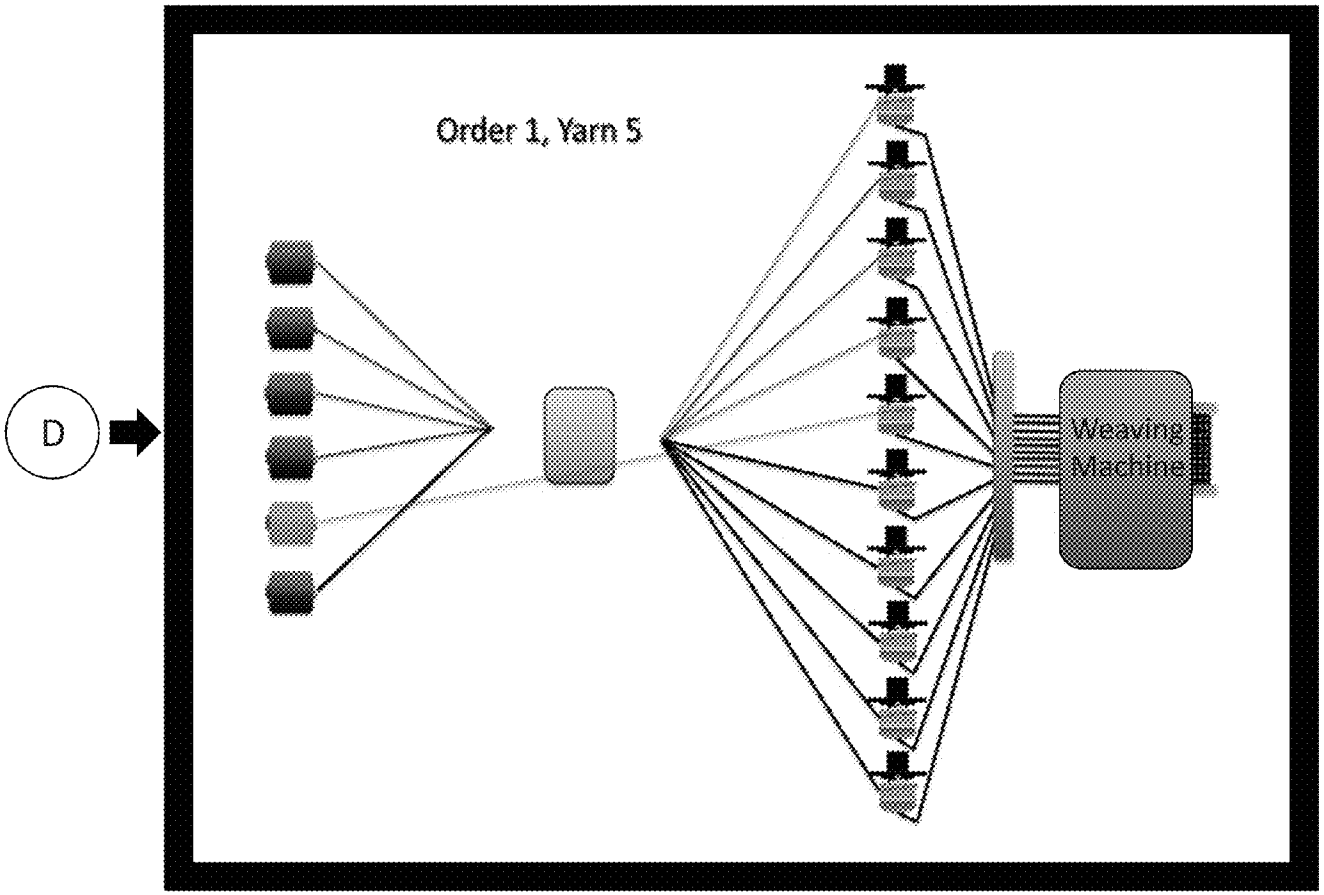
Figure 7G:
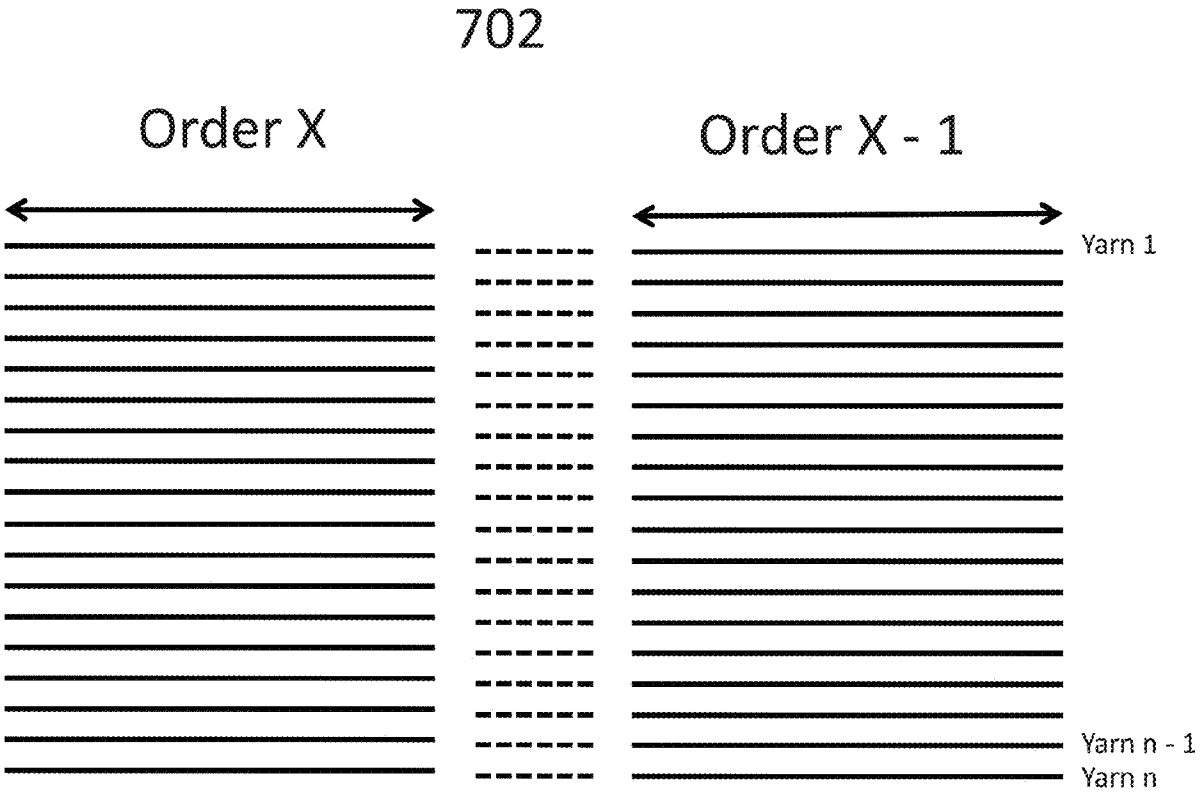

To construct the warp, a yarn from the inventoried package side (516) is selected by the main computer (corresponding to the specified fabric designed), as is a yarn from the regenerating accumulator side (512). The two ends are brought into the yarn joining device and joined. This means that the yarn extending from the selected inventoried yarn, through the selected accumulator, and through the connected warp yarn entering the weaving machine becomes one continuous piece of yarn, as illustrated by the broken line of FIG. 6. The continuous piece of yarn may have sections of the same or different colors, thicknesses or materials. Once the selected inventoried yarn is connected to the yarn in one of the regenerating packages, the motor on the regenerating package begins to spin. Alternatively, the regenerating packages can be geared up to a central motor and spin when it is their turn. This accumulates a specified length of the inventoried yarn onto the regenerating package. This newly joined and accumulated single piece of yarn is then cut near where it was joined, creating two ends of yarn (or, as noted above, may be manipulated as separate ends but not be cut until one of the ends is selected again). One end is placed back on the inventory yarn side (516) and held, and the other placed and held by the regenerating package side (512). The process can then select new yarns and continue the accumulation process. This process is repeated until all regenerating packages in the warp have a new storage of yarn that reflects the desired pattern that was input into the computer. The accumulated yarn is then pulled out of the exit of the regenerating packages as the weaving machine runs. Ideally, each of the regenerating yarn packages will also be capable of running the accumulating elements in reverse, in order to provide slack for operation of the grabbing and joining of the yarn extension device (518).

The new yarn that enters the regenerating packages can either be a continuation of the same warp pattern that is exiting the regenerating packages—effectively making the warp longer without the need for the creeling of new yarn packages—or the connected yarns can be of different colors, thicknesses, or materials, and therefore together represent a warp of a different pattern. The invention advantageously allows for a warp of the same or different patterns to be constructed without having to individually pick and place new yarn packages as previously required.

The flexibility afforded by the yarn extension device allows for any inventoried yarn to be connected with the yarn from any of the accumulators (i.e., any warp yarn) at any time. That makes possible the horizontal (cross-stream) assembly of a warp (FIGS. 7A-G). Horizontal assembly of a warp means that for an order x−1 (702), all yarns 1 through n can be assembled before any yarns 1 through n of order x are prepared. Even though yarn 105 of order x−1 must eventually be connected to yarn 105 of order x in order to be accumulated and pulled into the weaving machine, the connection can happen at any time since all the ends of order x−1 are held together (512) and can be accessed on command. Therefore, the system retains its continuity even when there is technically a physical separation between the same yarn n of different orders.

The horizontal assembly of a warp supports the notion that the disclosed invention is a novel automated creeling device. If one thinks about the workflow for a person or machine picking, placing, and tying yarn packages to the emptying set already on the creel, they're effectively replacing one yarn package at a time (yarns 1 through n) of warp x−1. The replacement movement goes from the package that provides the yarn for warp yarn 1 through the package that provides the yarn for warp yarn n. The yarn is therefore replenished horizontally, one warp in its entirety (warp x−1), followed by the next warp in its entirety (warp x) when the previous packages empty.

The horizontal assembly of a warp in the manner of the disclosed invention also makes possible the on-demand manufacturing of an order. Because order x−1 does not need to incorporate any yarns from order x to retain the continuity of the system, all yarns from order x−1 can be accumulated before any yarns from order x are touched. Therefore the entirety of order x−1 can be prepared and manufactured before order x is even submitted. Hence, the process of filling an order can begin immediately when the order is placed.

As yarns from order x−1 do not need to be connected to yarns from order x at the time of manufacturing order x−1, the system can assemble and weave orders of any length without those orders having to be connected to any other orders. In other words, the system does not aggregate miniature warps into a larger warp—it simply creates miniature warps.

Figure 8:
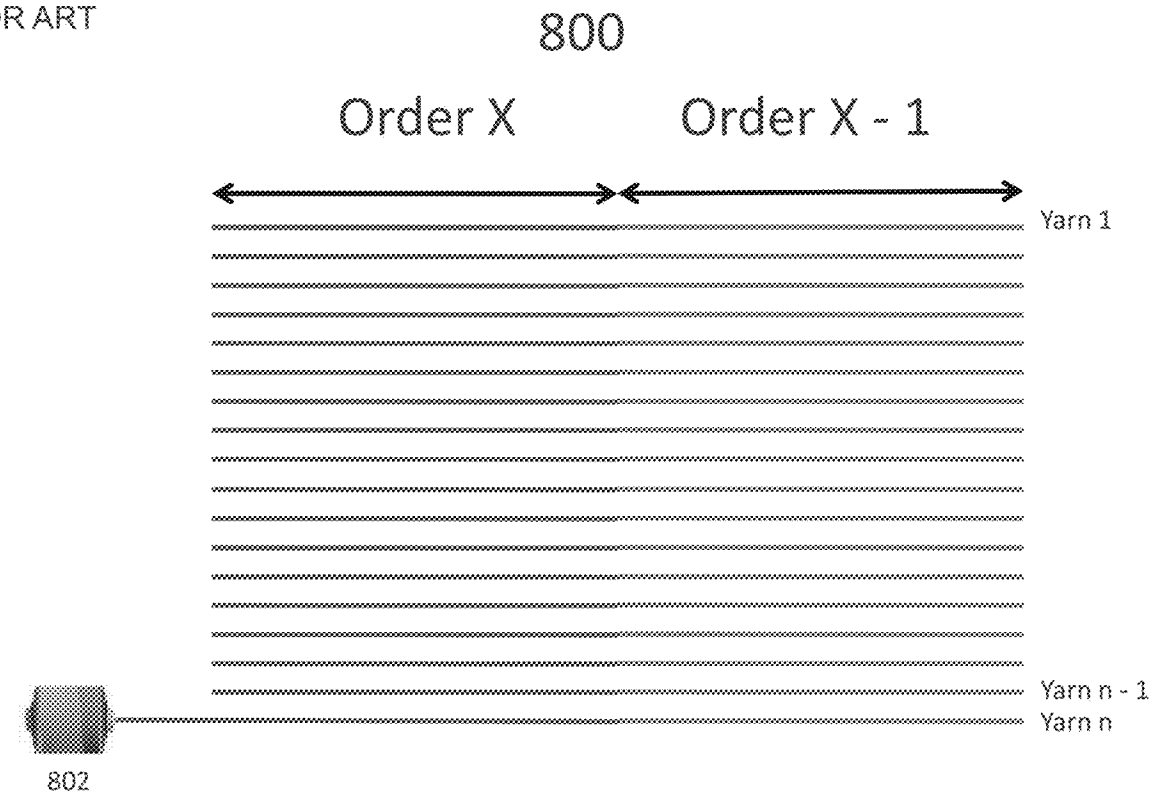
FIG. 8 PRIOR ART
FIG. 8 illustrates the nature of a yarn package such that it can only build up a warp vertically.

This is different from prior art systems that assemble a warp vertically, or downstream (FIG. 8, reference 800). The nature of a yarn package is that it provides the vertical length of the warp. Therefore, by connecting one color to another and winding onto a package, one is essentially connecting yarn n of order x−1 to yarn n of order x (802). The workflow is to batch a single yarn n from different orders until all orders have been accounted for in that yarn package for that yarn n. Then the next yarn package is made, which is the vertical connection of all yarns n−1 for all orders. As the machinery relies on connecting a single yarn n from one order to yarn n from the next order, the batching of all orders is required before any yarn packages can be produced and the warping process begun. Therefore, an order does not have the potential to start being manufactured the moment it is received—it has to wait on all other orders that need to be included in that batch. The size of the batch depends on how many orders the mill is comfortable spreading the set-up costs over.

An important application of this invention is to be able to make fancy fabrics that would never be made except at exorbitant cost using normal methods (for example, having the first 40 yarns of a warp be different colors), and that means being set-up for the possibility of each yarn in the warp being one of many colors. The reason this isn't done normally is because the cost of making sure a light-blue yarn package is at creel spot 1, a green package at creel spot 2, etc. for many colors is extremely laborious and costly.

The batching process required by the prior-art system creates two points of lag in the supply chain. The first is waiting for enough orders to be submitted to start making the yarn packages. The second is creating yarn packages that are now of increasing length and connections. So if order 1 is submitted, and 50 orders, for example, are required to achieve the proper length of the total warp, then order 1 must wait on 49 more orders to be submitted before the packages can be made. And then the making of the packages holds order 1 hostage for 50 times the amount of time required for just the yarns in order 1, as they must be connected to all the yarns in order 2, and order 2 must be connected to all the yarns in order 3, up through order 50.

The prior art system creates warps of normal length that are the aggregation of miniature warps. It does not make economical the manufacture of a single 2-yard warp, but instead is directed to the creation of one hundred 2-yard warps connected to each other. Using the prior art system to make a single 2-yard warp would place the significant set-up costs and labor entirely on the single 2 yards, rendering it prohibitively expensive and defeating the purpose of the prior art system.

Figure 9A:
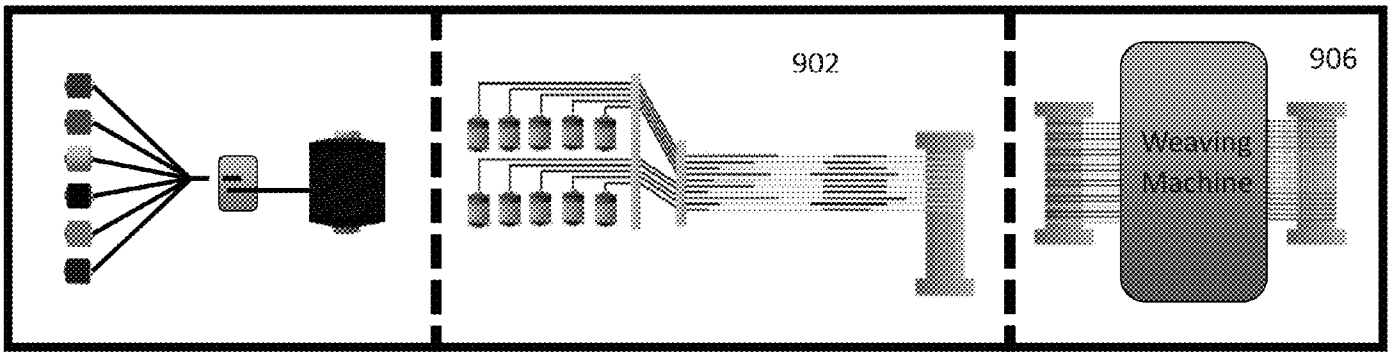
FIGS. 9A-B illustrate a workflow comparison between the prior art and an embodiment of the invention showing the discontinuity and labor required for the former and the continuity and labor-free process of the latter.
Figure 9B:
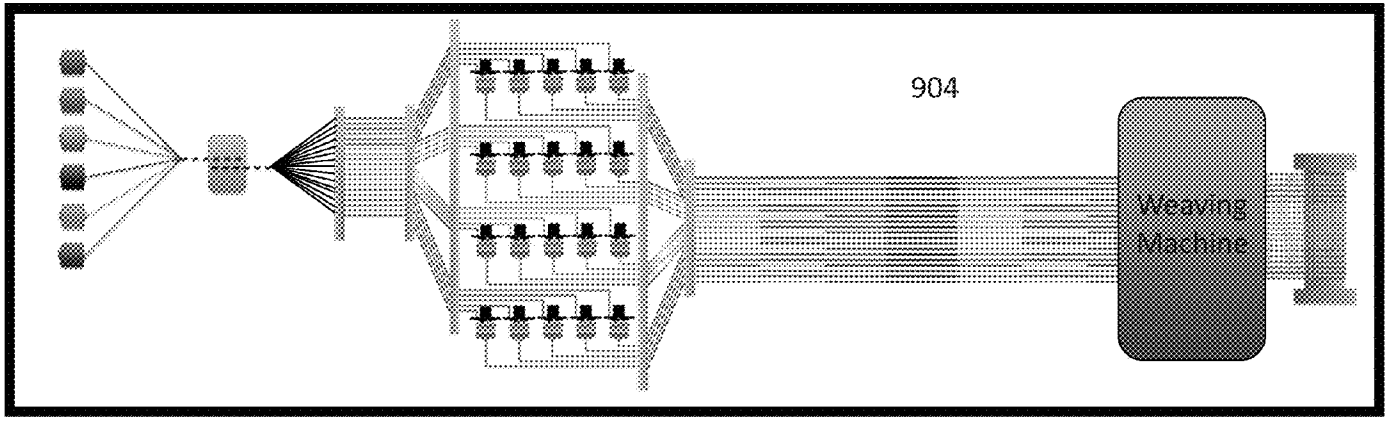

A workflow comparison between the prior art system discussed above and illustrated in FIG. 8 and the disclosed invention can be seen in FIGS. 9A-B, where vertical dotted lines represent breaks in continuity and the requirement of many hours of labor. Under a normal manufacturing set-up, including the prior art system, each warp set-up demands the placement of a new group of yarn packages on creels, the warping of those packages (902), and the placement of the warp beam in a weaving machine (906). Those steps take about 20 hours of labor at minimum (the majority of that time is spent in creeling) (902). With the disclosed invention (904), there is an initial set-up that is always in place (the regenerating yarn packages on creels).

Contrastingly, regarding the disclosed invention, instead of a laborer or machine putting a yarn package or subset of a yarn package on a creel, the regenerating yarn package connects to a specified yarn and accumulates it. And instead of a laborer dragging the ends of the yarn package into a weaving machine or onto a warp beam, the newly accumulated yarn is always connected to the end of the yarn from a previous order and follows it through directly into the weaving machine. The disclosed invention enables this connection to happen long after the previous order has been woven and shipped and merely requires the yarn ends of the previous order to be held for future connections to maintain continuity, and therefore should not be considered batching. During slow periods, a few extra yards of yarn may be accumulated per order so that yarn remains on the accumulator when the previous order is completely through the weaving machine. The amount of extra yards necessary may depend on the distance from the holding of the warp yarns (512) to the weaving machine.

The continuity may continue after the fabric exits the weaving machine. For instance, with a continuous fabric take-up device, fabric can be let out of the weaving machine, and using motorized nip rollers, be pulled through other steps, such as a cutting step. The cutting step may be executed by a CNC cutting machine, a laser cutting machine, or any machine that can cut fabric based on dimensions input into a computer.

The inventoried yarns can be of known length and therefore a computer can alert a technician as a color or weight is used up and needs replacement. As inventoried yarn packages do not directly relate to the actual warp being produced and are provided as options from which pieces of set length are pulled, the yarn packages can be of increasing length to theoretically infinite length without affecting the warp. Therefore, the longer the yarn packages, the less often a person needs to replenish them to fulfill orders.

Figure 10:
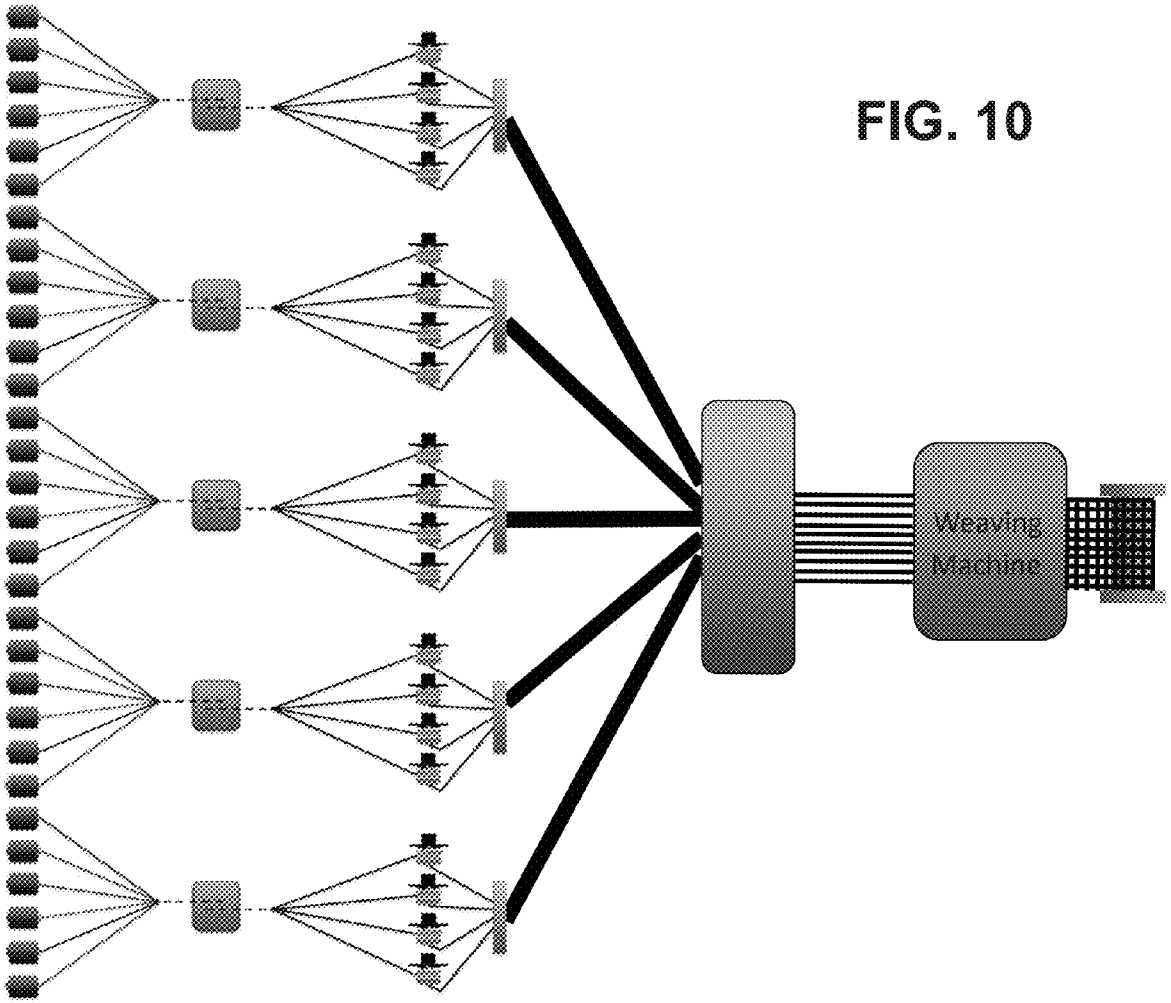
FIG. 10 illustrates a multi-module embodiment of a textile machine that speeds up the amount of time required to assemble a warp in accordance with an embodiment of the invention.
Figure 11:
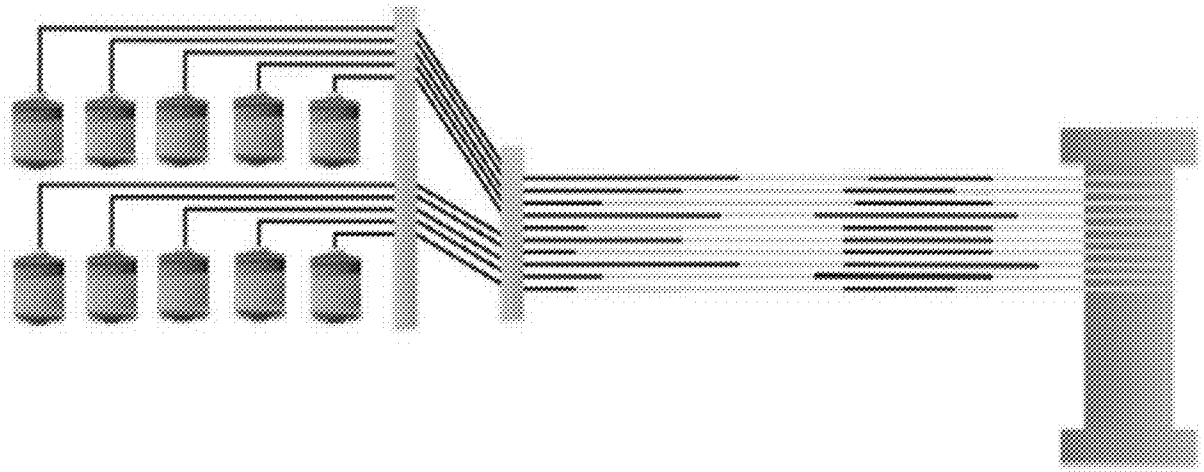
FIG. 11 PRIOR ART
FIG. 11 illustrates a larger warp made of an aggregation of mini-warps.

The number of regenerating yarn packages in the system is the same as the number of warp yarns, which is determined by the number of ends (warp yarns) the weaving set-up calls for. This can be chosen by the mill, which installs weaving machinery based on how many ends-per-inch it desires and the overall width intended for the fabric. The modules (including elements 502, 516, and 504) servicing the warp yarns, however, can be a different number and/or have different set-ups, such as the exemplary set-up shown in FIG. 10 where five different modules are serving a single warp.

The more modules, the fewer warp yarns/regenerating packages each one services, and the less time it takes for the warp of an order to be assembled. For instance, if only one module were used to service a 3000-yarn warp, and each grab-join-accumulate cycle took 5 seconds, then the total time required to assemble a warp order would be 15,000 seconds, or a little over 4 hours. But, if 20 modules were used, and therefore each module was servicing 150 yarns, and each cycle took 5 seconds to complete, then a warp order would be finished in 750 seconds, or a little over 12 minutes. Any suitable number of modules and/or set-ups can be used. Smaller set-ups could be used to make swatches, labels, or any narrow fabric that requires warps of a few pieces of yarn (and therefore fewer regenerating packages) to a few hundred pieces. As full-sized textile warps vary from a few dozen inches wide to a few yards wide, set-ups can number into the many thousands of regenerating packages.

Figure 16:
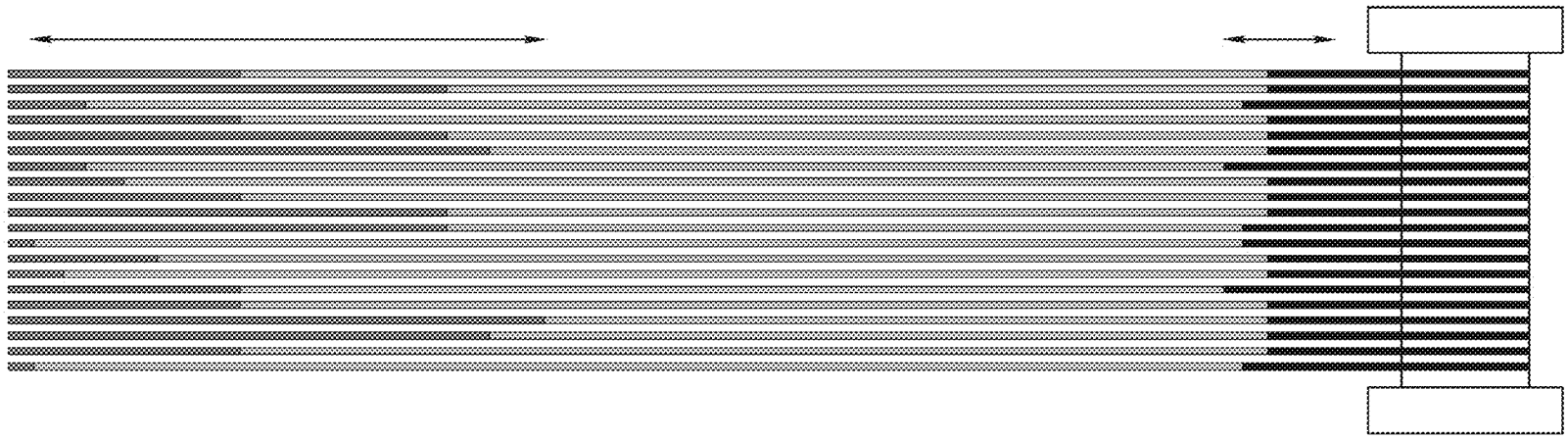
FIG. 16 PRIOR ART
FIG. 16 illustrates joint drift.

Under the prior art systems, even when yarns are warped with the same tension levels set in the creels, the yarns can still take on differing tensions just by the nature of their differing distance to the warping device. When a yarn package is a solid color, it can be difficult to notice that a yarn is slipping behind other yarns. When a warp is made of joints of connected yarns, as with the prior art system, what starts out as a solid line of joints quickly becomes a haphazard drifting of the joints (FIG. 16). The longer the warp, the more that error builds. Since, with the prior art system, yarn packages must be made in advance and yarns with joint drift vary from warp to warp, the drift cannot be accurately compensated for on a per-yarn basis in package creation. The greater the distance between the two farthest joints in a section and the more those drifting joints impose on other sections, the longer that section has to be to have an unadulterated cross-stream section of proper length. With the disclosed machinery, any joint drift can be compensated for in future orders as the accumulators operate independently and only one order is made at a time. The independent operation means one yarn can be made a different compensating length from the rest. And since only one order is put together at once, future orders don't see a buildup of joint drifts, as any drift can be recognized and compensated for in the very next order.

The disclosed invention is primarily described in the context of a warp but is not limited to this application. For example, the invention could also be applied in the context of a weft. Though a weft package can be changed in less than 30 seconds, it may be advantageous for that change to happen without labor. The weft application is much simpler than the warp application and could use a knotter without any repercussions. One module could be used, and instead of connecting regenerating packages to inventoried yarns, the yarn at the back of weft feeders could be connected to the inventoried yarns. Also, once the yarn of a weft feeder is connected to an inventoried yarn, it could remain connected until that order was finished being woven. As for the remaining yarn on the weft feeder spool from the previous order, that could either be woven out, it could be pulled out by a person, or it could be pulled out by a motor, and the pulling of each yarn could stop when a knot detector signals the next yarn has been reached.

The disclosed invention can be applied to any situation in which yarn package replacement causes labor input or downtime. The more packages the process requires, the more useful is the disclosed invention. Accordingly, the disclosed invention can be applied to knitting applications, such as flat knitting, warp knitting, circular knitting, or any other suitable knitting.

There are reasons and ways to use fewer modules (less yarn inventory needed) or many modules (less time servicing warp). Multiple layers of regenerating packages before the ones that directly feed the warp could be used. There are many ways of rearranging and applying the disclosed invention, which is not limited to the aforementioned embodiments.

Ancillary Machinery and Processes

Figure 12A:
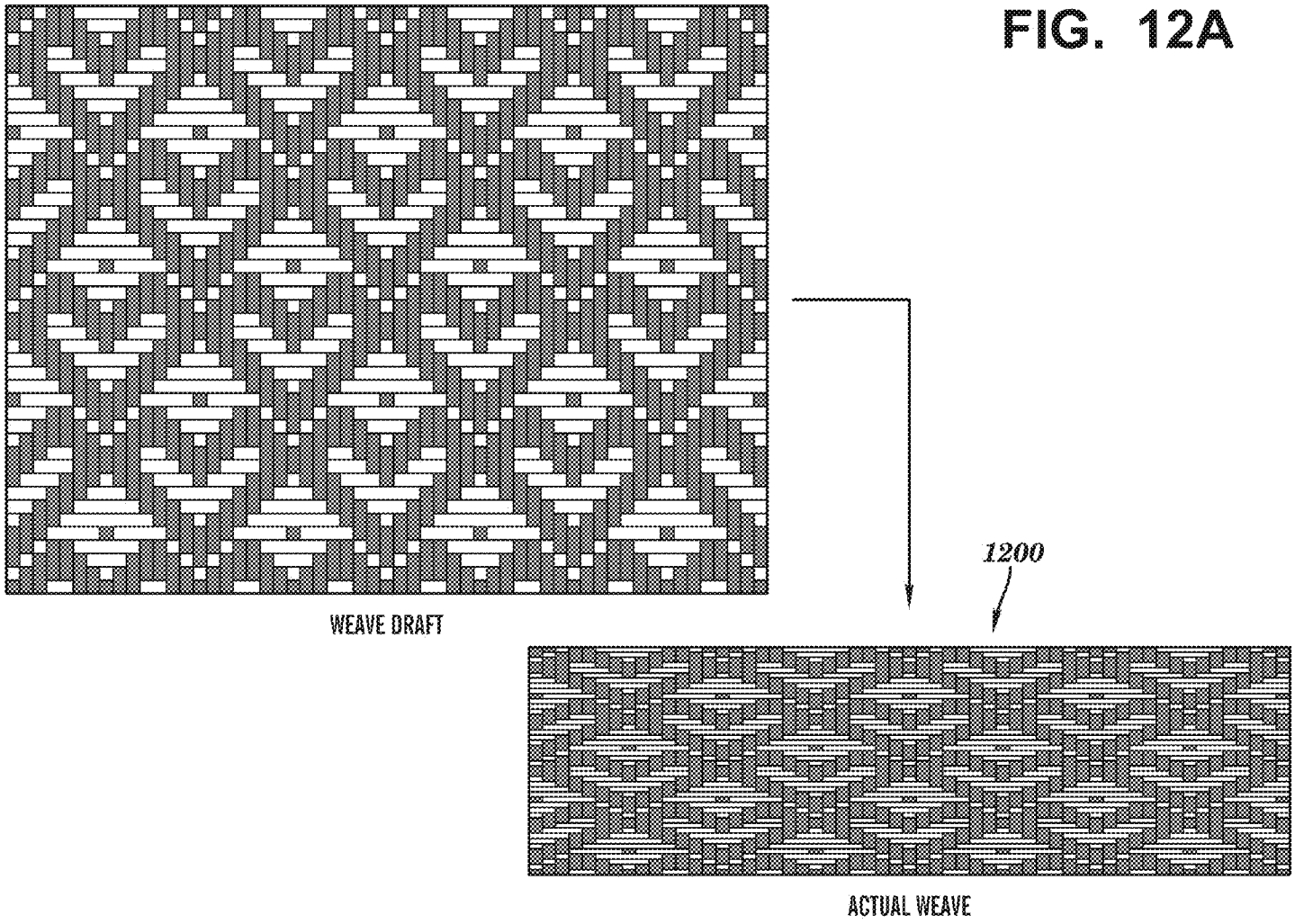
FIGS. 12A-B illustrate "Automatic Weave Distortion Identification" in accordance with an embodiment of the invention. The system can quickly, automatically and with little fabric waste diagnose and fix aspect ratio issues between weaving drafts and the actual fabric woven based on those designs.
Figure 12B:
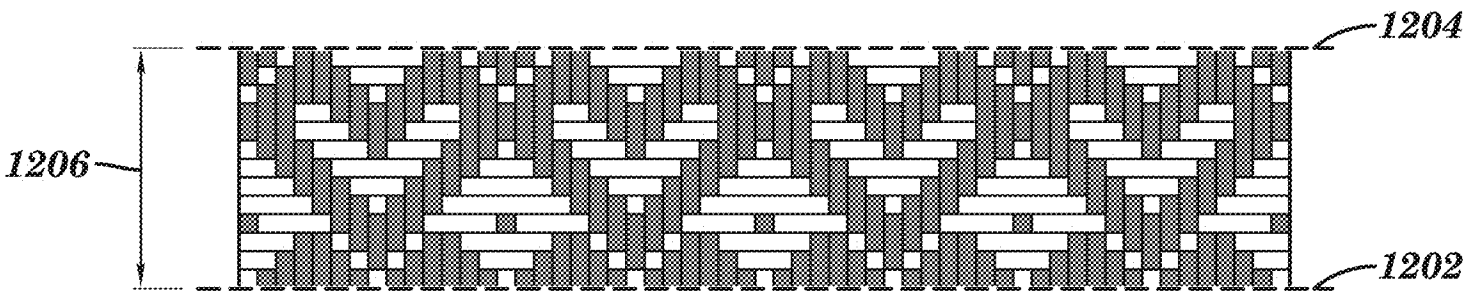

1. Automatic Weave Distortion Identification (FIGS. 12A-B)

When fabric is designed, it assumes a certain density ratio for the warp and the weft. For instance, if the user is designing for 80 ends per inch (abbreviated as "epi," representing warp threads per inch) by 80 picks per inch (abbreviated as "ppi," representing weft threads per inch), then a square inch of the weaving draft will look like an 80 by 80 square configuration of boxes. Any designs made on that weaving draft will be made of those square boxes at that aspect ratio, just like pixels on a screen. Therefore, if the size of those boxes changes, the design will look different.

When a weaving machine weaves a design, it doesn't necessarily come out with the same aspect ratio as the intended design for the fabric. Though the warp maintains a set density, the weft is beaten into the warp, and depending on how hard or soft that beat-up is based on the speed at which the warp is pulled through, the density of the weft changes. As illustrated in FIG. 12A, if the density of the weft in the fabric turns out differently than on the weaving draft, the design will be stretched or squashed (1200).

What makes the correct beat-up tricky to infer pre-production is that every weave creates different tension levels in the yarns, which creates an unpredictability in the weft yarn's response to a beat-up setting.

When weaving very short yardages, it is important to quickly identify an aspect ratio problem and make rapid or automatic changes so that the fabric emerges looking like the intended design.

FIG. 12B illustrates a small fabric section which may be woven in association with a method for determining the aspect ratio of an actual weave pattern. The disclosed method has a special weft yarn 1202 inserted into the warp. Then a certain number of wefts/picks of the intended design is woven, and then another special weft yarn 1204 is inserted. An eye or detector configured to identify the special weft yarns 1202, 1204 then reads the distance 1206 between the special weft yarns, one of which is inserted at the beginning of the section and the other at the end. The computer now knows the number of weft insertions in the section as well as the distance taken up by those weft insertions, or the density. It compares the intended density (ppi) of the weaving draft with that of the woven section, and therefore can calculate how to alter the beat-up to make further weaving of that design of the proper density.

The special yarns can be metallic or of a different color than the rest of the weave—any suitable yarn that allows them to be distinguished from the woven section that they are separated by so the distance in between them can be measured.

For example, suppose an order needs 80 picks (wefts) per inch to come out looking as the weaving draft intended. 82 weft insertions of that design are woven. The first insertion is a special thread. The next 80 insertions are normal threads. The last insertion is a special thread. The eye then reads the distance between the special threads. If the distance is not 1 inch, the beat-up is altered. For example, if the eye reads a distance of 1.2 inches, the weft threads are not being beat-up as densely as they need to be for the image to emerge woven without distortion. The eye submits this number to the computer, which knows that in order to pack 1.2 inches of wefts into 1 inch of wefts, it has to increase the beat-up by a certain amount. The fabric can then be run in its entirety or the process can be repeated with the new anticipated settings to ensure the changes create the intended weft density.

In some implementations, instead of altering the beat-up to match the weft density of the weaving draft, the computer could determine that smaller or larger weft yarns should be used. The computer could also determine that a change in the size of the weft yarns and a change in the beat-up setting are both necessary.

After practicing this method for a while, it is possible that an algorithm could be developed that allows the computer to accurately guess what weft yarn size and/or beat-up settings must be used to weave the correct aspect ratio given a certain type of weave without first having to test a small strip.

The prior art method of ensuring that a design is woven at the same aspect ratio as the weave draft is by sampling. A few yards of the fabric is woven and looked at by a person. If the design looks skewed, they alter the beat-up and try again. For certain designs that require greater accuracy (a logo, for instance), they might take some measurements to ensure the ratios of the parts are correct, and then do another trial. With the automatic process described, however, such a small strip can be woven because no image needs to be recognized. Instead, the actual weft density only needs to be compared with the intended weft density, which can easily and automatically be measured by an eye or detector as disclosed in the described process.

2. Online Design of Textiles

The above-described devices and methods for manufacturing textiles facilitate cost-effective on-demand manufacture in a way not possible using previous equipment and techniques. Because even relatively small batches of specially designed textiles can be manufactured using these techniques, software may be provided to allow a user to design and order specialized patterns of fabric. In some implementations, the following software may be run online by means of a browser or application in communication with a web server, or may be run locally on a user's computing device prior to the details of a designed fabric and order being sent to a manufacturer.

Figure 13A:
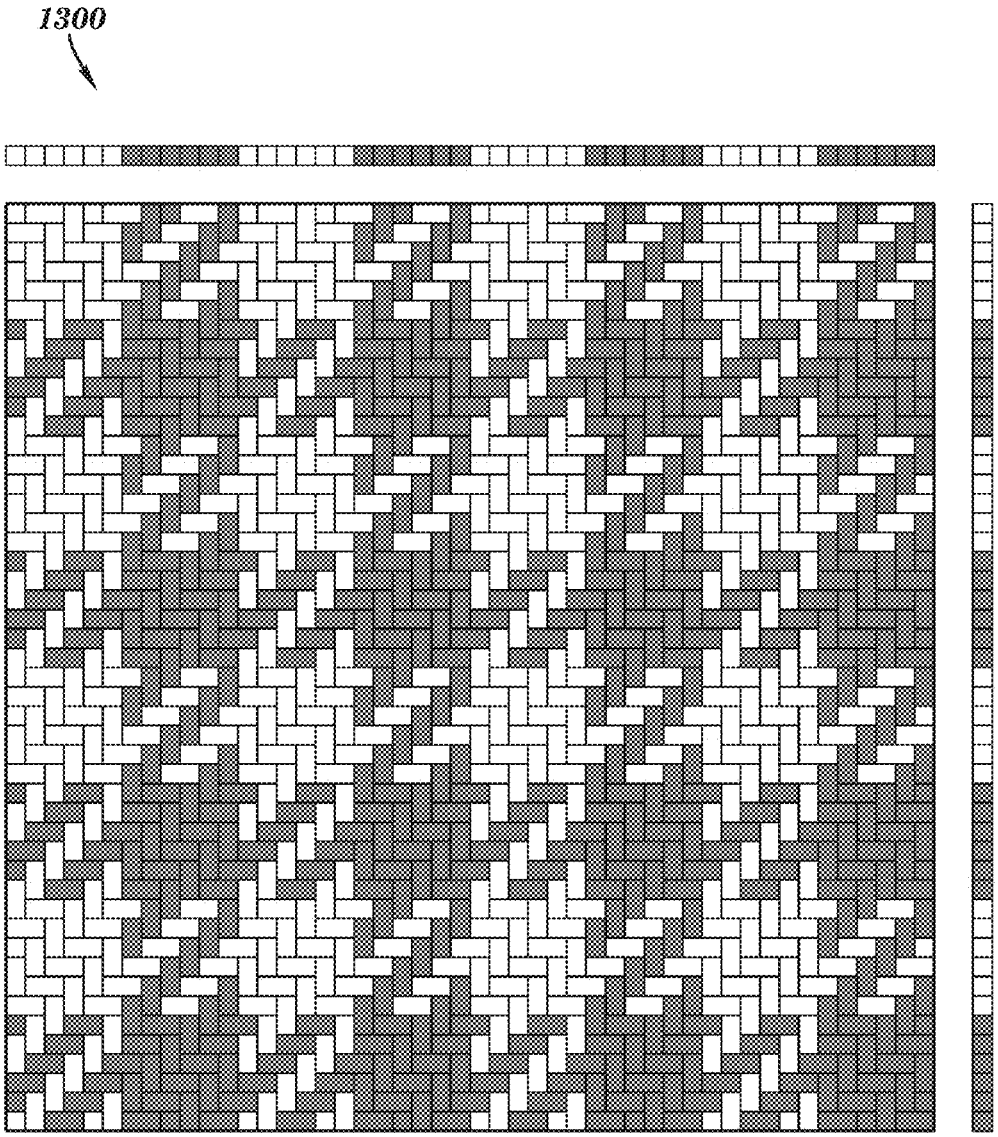
FIGS. 13A-B illustrate the user interface for a weaving draft and a way for a user to easily change warp and weft patterns in accordance with an embodiment of the invention.
Figure 13B:
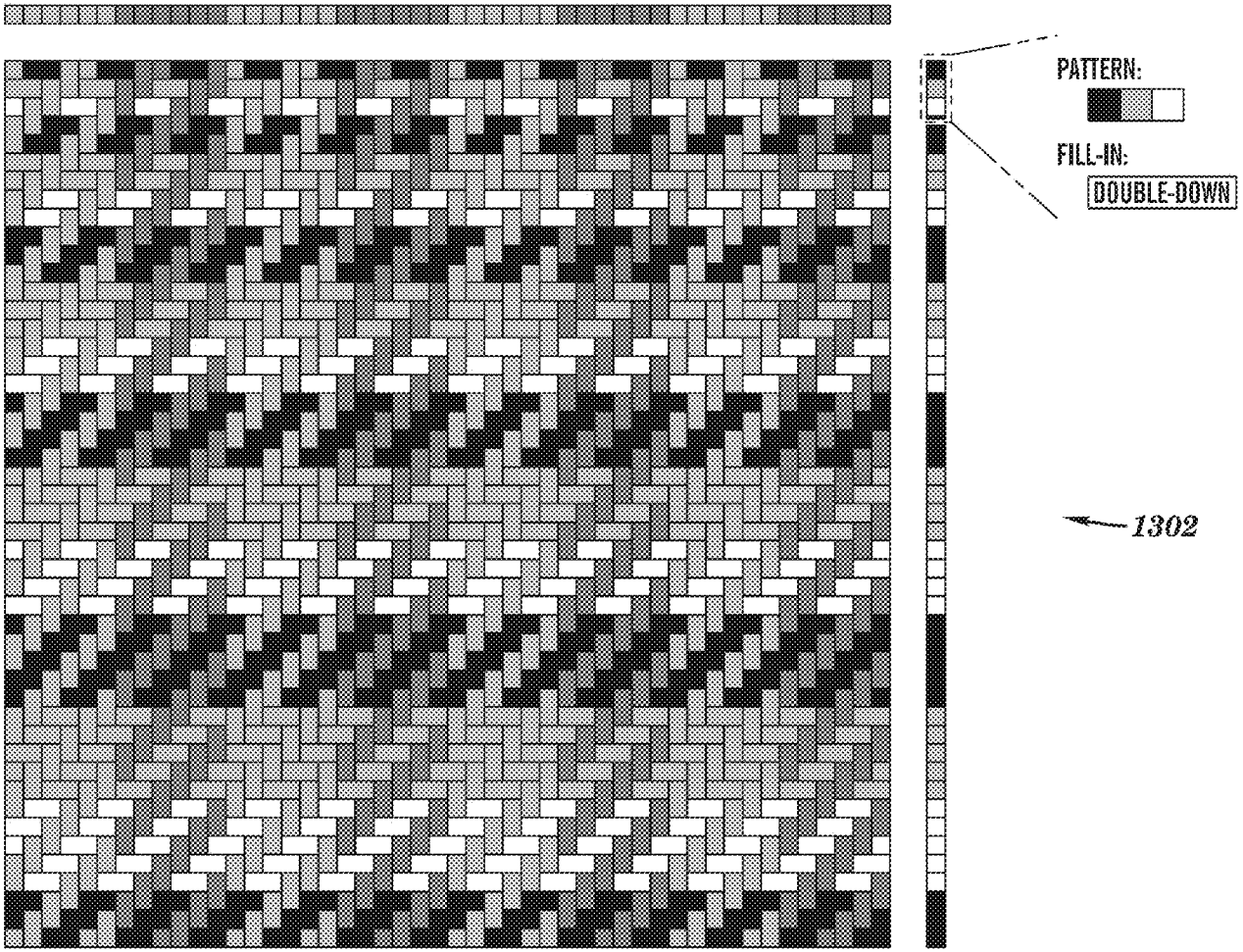

FIGS. 13A and 13B illustrate screenshots (1300, 1302) of a computer application presenting a manipulable weaving draft with warp colors in boxes on one side, weft colors in boxes on a perpendicular side, and the weave in the middle. The application allows a user to zoom in and out on the weave, as well as on the warp and weft representations. In some implementations, a magnifying glass function may allow a user to magnify a section in either the weave draft or the warp and weft representations without changing the zoom level on the whole image. The application may include a method for the user to quickly fill in the warp and weft colors of multiple yarns. A toolbar may include options to make the entire warp or weft one color, or to repeat a pattern, or to expand a color sequence down the warp/weft boxes using various algorithmic or random sequences that allow automatic variations in the patterning. For instance, a user could select the first three yarns/boxes of the weft as green, then purple, then maroon. If they then selected that they'd like that pattern repeated "forwards-backwards," then the computer would fill in all the weft threads adhering to that pattern (the first six would be: green, purple, maroon, maroon, purple, green). If the selected pattern were expanded using a doubling algorithm, for example, the first few wefts would be: G, P, M, G, G, P, P, M, M, G, G, G, G, P, P, P, P, M, M, M, M, essentially doubling each color each turn (1302). Many different algorithms could fill in the warp and weft boxes in many different ways for vastly different results without much effort by the user.

As shown, the weave draft is able to be edited and viewed in different representations—as boxes and as simulated threads. Clicking on a box (or thread intersection) switches which thread is on top.

Figure 20:
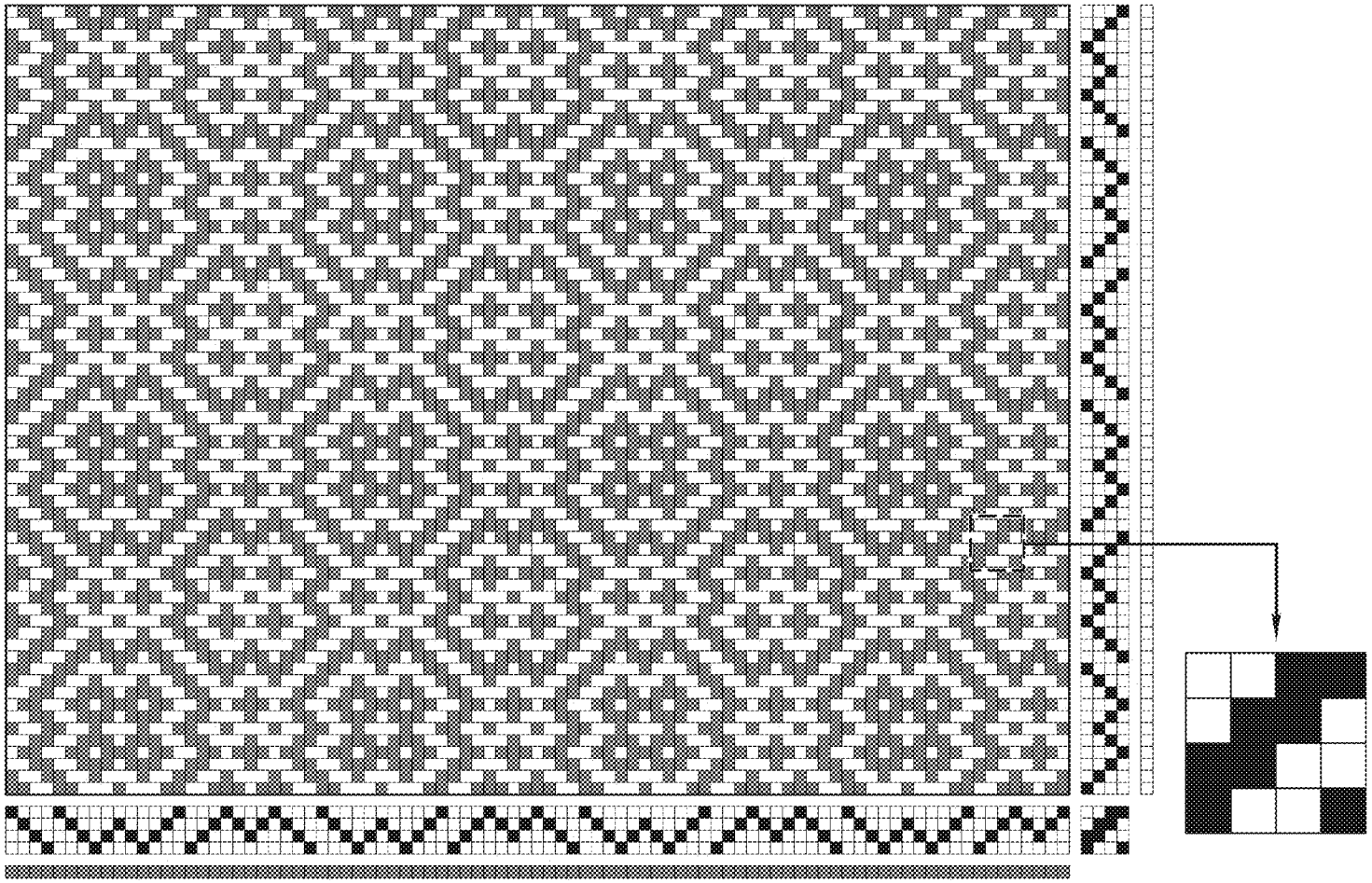
FIG. 20 illustrates the unit of a weave family in relation to the larger weave.
Figure 21:
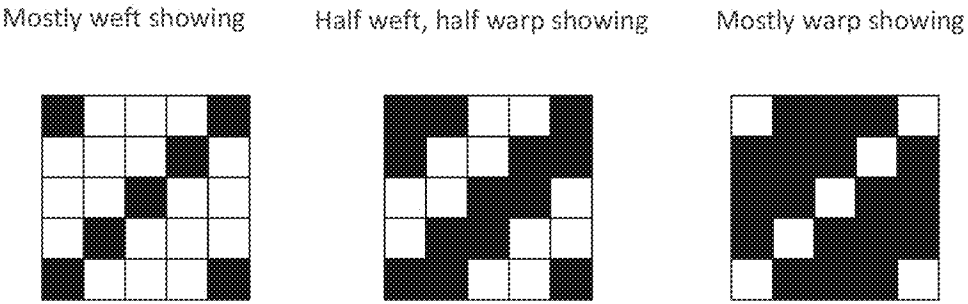
FIG. 21 illustrates an example of the gradations of shading within a weave family.

Weaves have to follow certain rules to be manufactured. One rule is that different weave families cannot be used in the cross-stream direction in the warp. The reason is that threads take on different tensions depending on the weave family used. Therefore, a user designing a weave online needs to be guided to create a manufacturable weave without having to know all the rules of weaving. One way to do this is to allow drawing or weave alteration with a weave family as a unit (FIG. 20). For instance, if a user intends to create a smiley face on a fabric that is a type of twill, then the "tip of the pencil" for drawing the design could be the smallest (or a small) unit of that twill. The number of pencil tips within a family are determined by the number of shades (percent of warp showing and percent of weft showing) that family has (FIG. 21). Drawing on a weave essentially means flipping whether the warp is lifted or sunken, which determines whether the warp shows or the weft shows on the fabric.

Figure 14A:
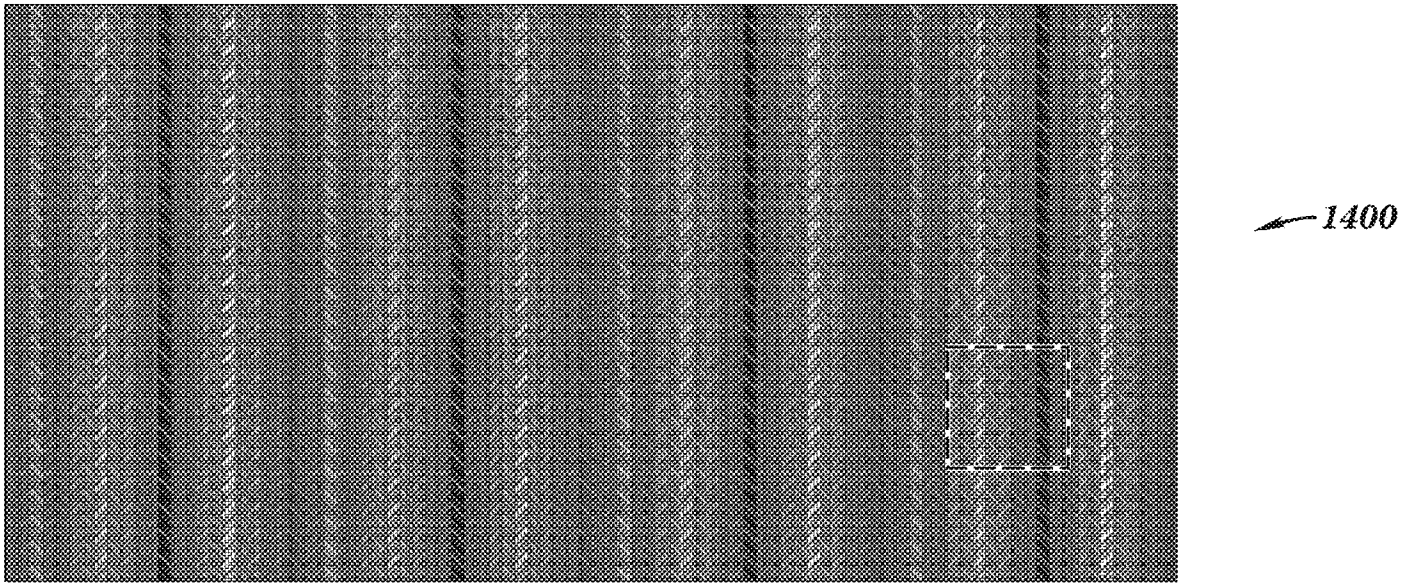
FIGS. 14A-B illustrate a "Swatch Shot" in accordance with an embodiment of the invention.
Figure 14B:
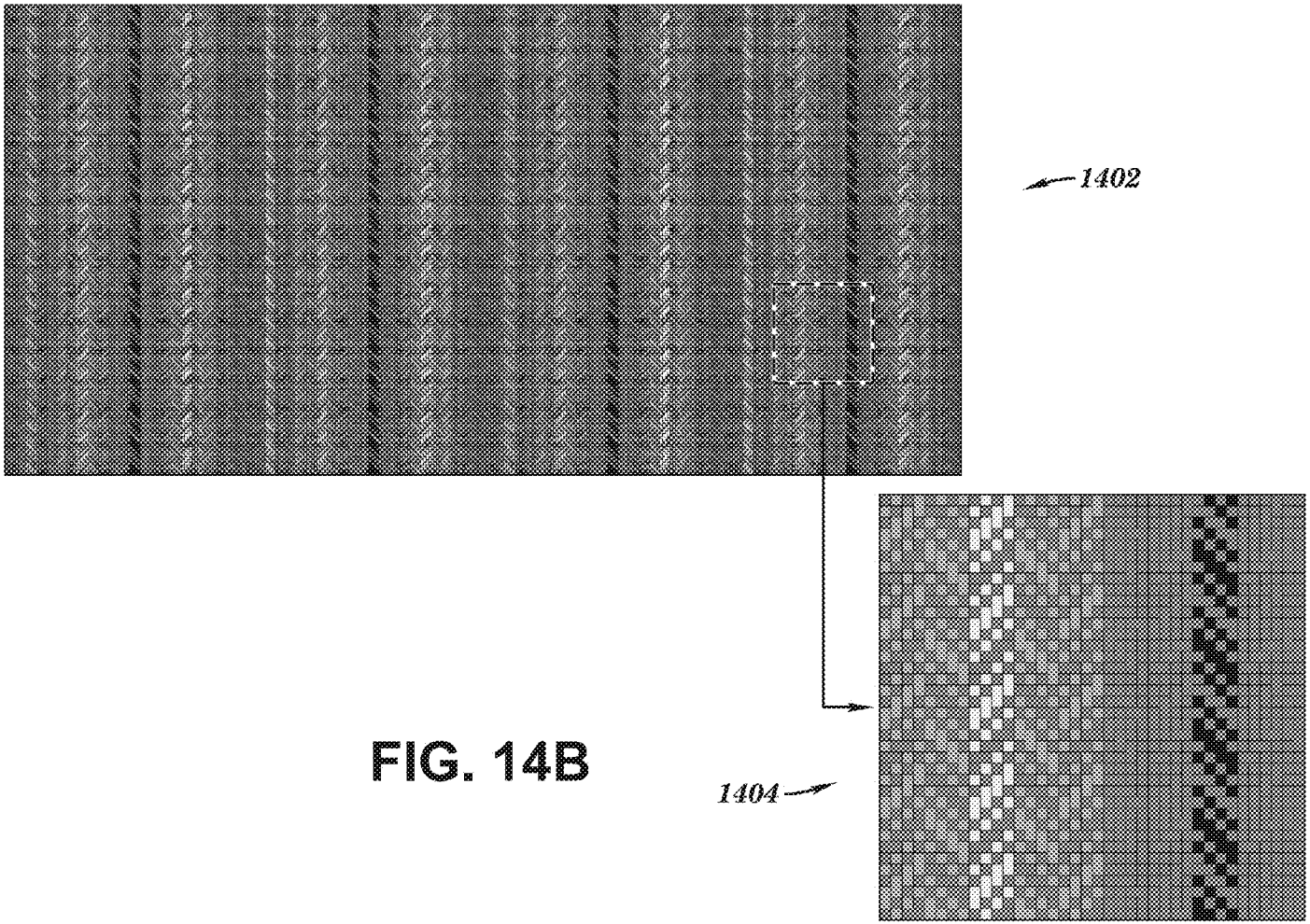

The methods and devices described herein can also facilitate the creation of small fabric swatches, particularly if a smaller weaving machine or label weaving machine is used in conjunction with the devices. FIGS. 14A-B illustrate screenshots (1400, 1402 and 1404) in which a user can identify and display a virtual swatch of fabric from the virtual woven pattern by moving and confirming the location of a highlighted area as shown. The highlighted area may be automatically configured to correspond to the size of a manufacturable swatch (for instance, if a swatch is 6 inches by 6 inches, and the weaving diagrams are all designed at 80 epi and 80 ppi, then the swatch shot would be 480 squares by 480 squares). The resulting swatch as displayed (1404) could be ordered and manufactured.

As illustrated, the fabric may be depicted as an array of boxes that represent the weave pattern, corresponding with the actual weaving length, width, and density. For example, if a particular machine is configured to produce weaves that are 80 epi by 80 ppi with a fabric width of 1 yard and a length of 4 yards, then that would be graphically represented by an array filled in with (80*36)×(80*36*4)=33,177,600 boxes which would represent the crossing of the warp and the weft. The software may be configured to adequately reflect the visual character of the weaving pattern at multiple zoom levels, such that at low magnification the fabric matches the overall effect, while when the user zooms in, the particular boxes, representing thread crossings and individual threads, can be seen.

Figure 15A:
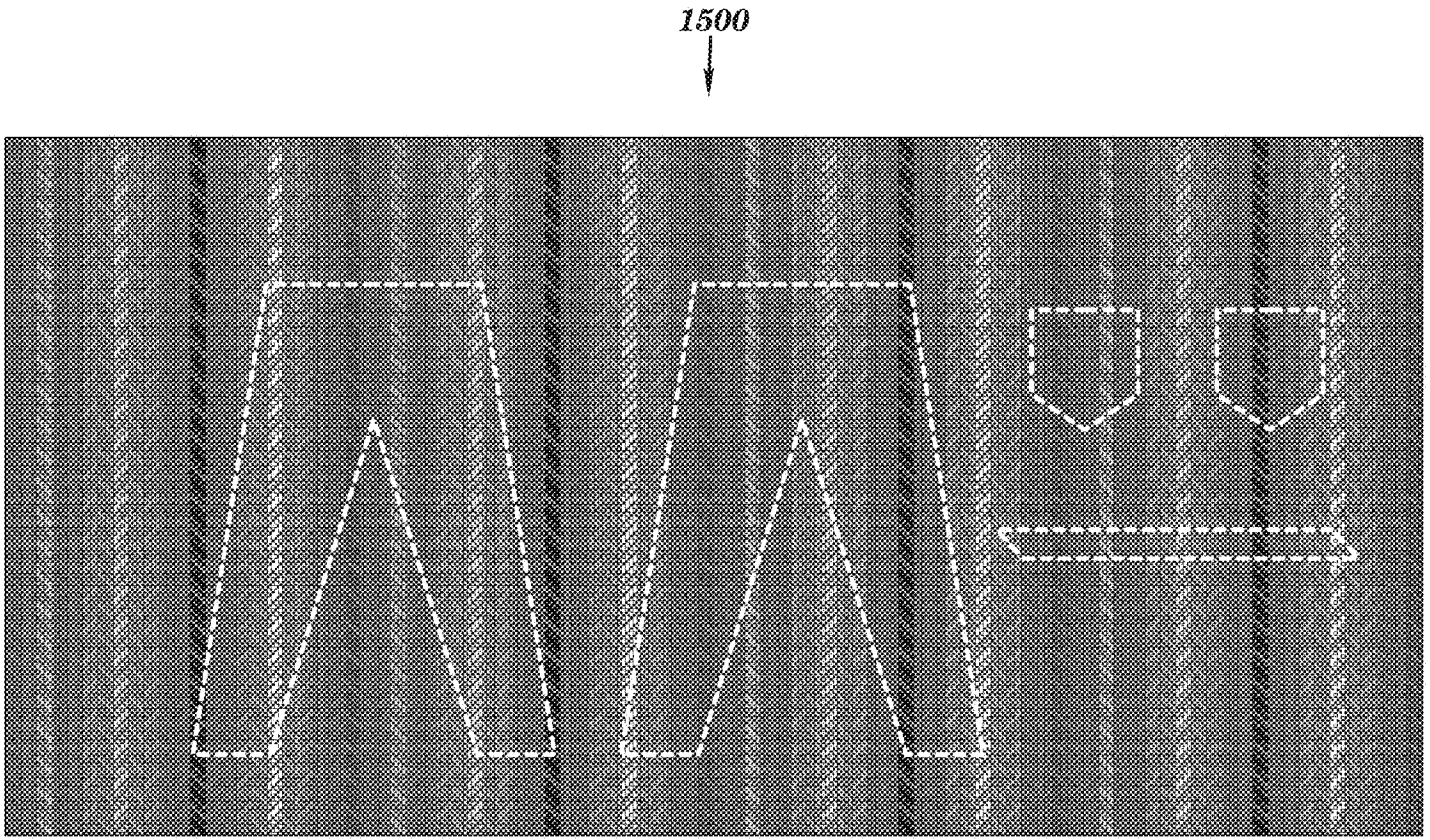
FIGS. 15A-C illustrate chalk outlines of an article of clothing on fabric, which a user can drag, thereby changing what parts of the fabric are encompassed in the article of clothing in accordance with an embodiment of the invention.
Figure 15B:
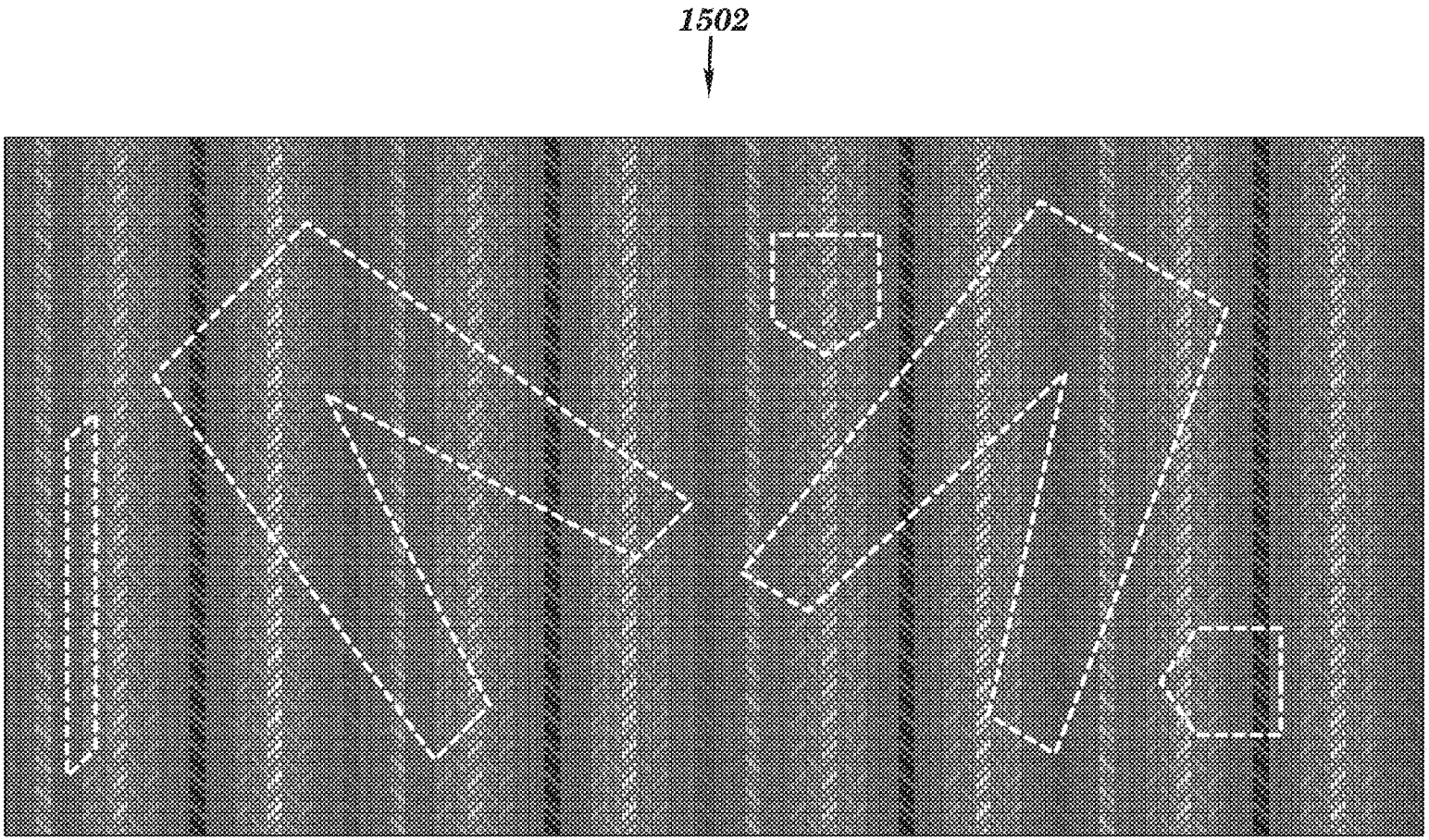
Figure 15C:
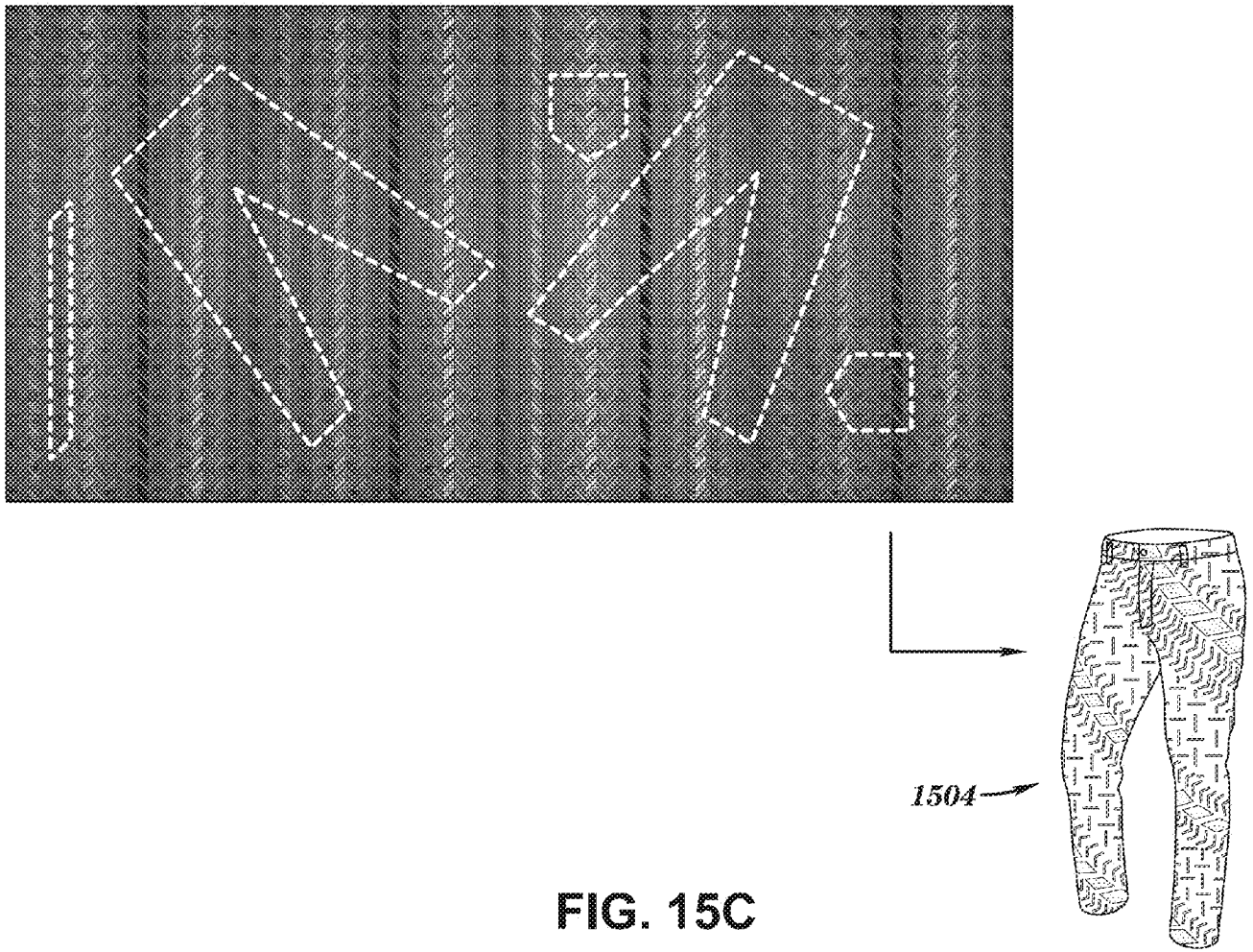

As illustrated in FIGS. 15A-B, a user can design specific clothing by positioning pattern cut-outs of each of the fabric pieces for that clothing on a display representing the particular designed fabric. Alternate positions for the cut-outs are shown in the different screen shots 1500 and 1502. FIG. 15C shows an example of a virtual pair of pants 1504 automatically generated from the positioned cut-outs. In some implementations, graphic elements may be included in generating the virtual pair of pants; for example, the display may go from the flat, chalk-outline-on-fabric view to the pants-assembled view by displaying the different chalk outlines virtually jumping off the fabric (with the fabric inside the outlines) and snapping together into the recognizable pants (1504). In some implementations, a CNC or laser cutting machine may receive data corresponding to the positions of the cut-outs as chosen by the user, and may automatically make cuts corresponding to the data.

Figure 22:
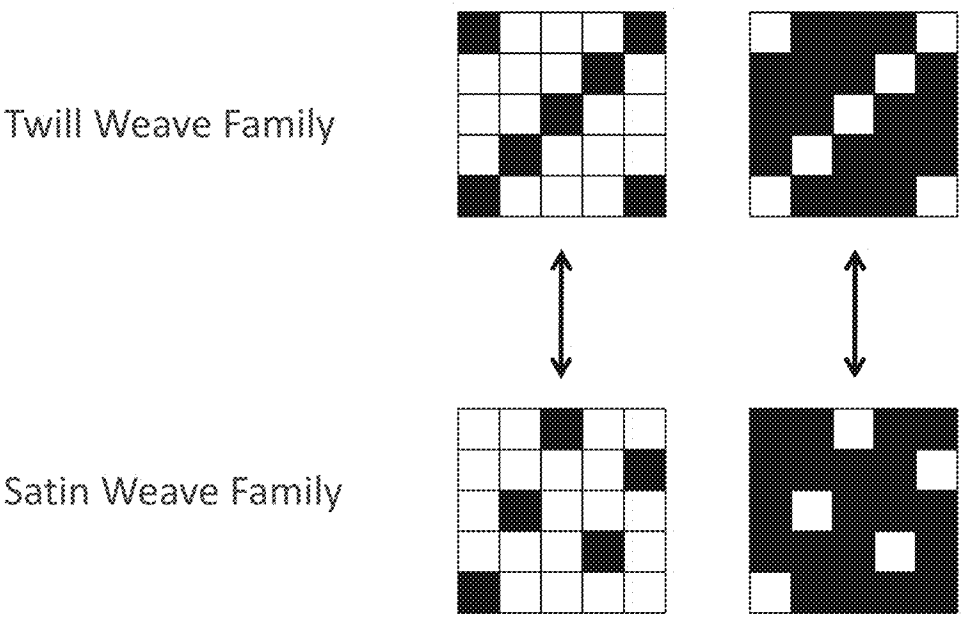
FIG. 22 illustrates the similarity of shades between weave families.

In some implementations, users may be able to make their fabric designs available to other users. For example, if a user in Tokyo designs flower fabrics, and a different user in Louisville wants to use one of his fabrics on a dress (even if the fabric is represented on a shirt), she can go into his virtual design center, drag the fabric design into her toolbox, from which she can then drag it onto a draft of a dress ("pattern drafts" are the outlines of pieces of clothing which can be cut out of fabric and sewn to make the article of clothing). Once it's in her toolbox, she can make alterations, like changing warp and weft colors or parts of the weave. If she likes only a part of the weave on the fabric he created (a motif), she can select that part and drag it into her toolbox, and from there drag it onto a fabric that she likes. A portion of the fabric can then take on the same weave as the motif. The fabric could either retain the warp and weft colors of the native fabric or switch to the warp and weft colors of the dragged motif. An automatic check or conversion could be performed to ensure compatibility between the design portion being introduced and the original fabric. This check could be done by comparing the type of pencil (i.e., the weave family) that the motif was drawn with to the weave family of the native fabric. It could also be done by converting the weave family of the motif to the weave family of the original fabric. This would be done by automatically changing the "pencil tip" that the motif was drawn with. Within one weave family, there are many possible pencil tips, each having a different arrangement of lifts and sinks that adhere to the rules of that weave family, and therefore each showing a different shade—from looking mostly like the warp to looking mostly like the weft. What this means is that each weave family (besides plain weave) has at least a dark expression (mostly warp showing) and a light expression (mostly weft showing), and some weave families have many shades. If a motif were made as a twill, and the original fabric were satin, then the pencil tip would convert to the satin that is the shade equivalent of the twill pencil shade used (FIG. 22). Though the pixels would be different, the overall image would look pretty much the same.

When a fabric design is made, the only information being stored is: if the warp or weft is on top (represented by the warp or weft color showing for that box), and what the color of the warp and weft is for each thread. Therefore, when a design is selected from a fabric and dragged onto a new fabric, the boxes of the design area of the old fabric are just converted to the new design portion's settings for warp and weft lifts and sinks.

The previous embodiments of the invention are intended to simplify weaving draft designing for customers who are not trained in textile design. However, this does not limit the options for more advanced consumers, who may want to design on a typical weaving draft (though one that is represented online) without the simplifications and that includes all the features normally used to make textile designs (e.g., threading, treadling, tie-up, and drawdown information).

Various aspects of the invention are described as being implemented using one or more computers. The computer can be any suitable device with a processor and memory. For example, the computer can be a desktop computer, a laptop computer, a tablet computer, a cellular telephone such as a smartphone, or any other suitable computing device or combination of computing devices. For example, in embodiments describing the textile machine and/or automatic weave distortion identification, the computer can be directly or indirectly connected to the textile machine (e.g., via a physical cable, wirelessly, or a communication network). As another example, in embodiments describing the online design of textiles, the computer can be coupled to a communications network. The communications network can include, for example, the Internet, the intranet, local area network, wide area network, or any other suitable network or combination of networks.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other structures, systems, methods and media for carrying out the several purposes of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

What is claimed is:

1. An apparatus comprising:

a plurality of yarn packages each comprising a bobbin having a strand of yarn wound around the bobbin;

a creel having mounted thereon a plurality of regenerating yarn packages each having accumulated thereon a strand of yarn;

a yarn extension device having a first plurality of inputs each coupled to a strand of yarn from one of the plurality of yarn packages, a second plurality of inputs each coupled to a strand of yarn from one of the plurality of regenerating yarn packages, and a yarn joining device operative to join a first strand of yarn from one of the first plurality of inputs to a second strand of yarn from one of the second plurality of inputs to create a joined strand of yarn;

at least one motor configured to control the plurality of regenerating yarn packages and operative to cause one of the plurality of regenerating yarn packages to rotate and accumulate the joined strand of yarn; and a computing device operative to automatically control operation of the yarn extension device and the at least one motor.

2. The apparatus of claim 1, further comprising a weaving machine operative to receive a warp comprising a parallel set of yarns pulled from a predetermined number of the plurality of regenerating yarn packages in a predetermined arrangement, and further operative to apply a weft over-and-under the parallel set of yarns in a perpendicular manner to generate fabric.

3. The apparatus of claim 2, wherein the creel is configured to replenish yarn on the warp at a same rate as the yarn being pulled into the weaving machine.

4. The apparatus of claim 2, wherein the creel is configured to replenish yarn on the warp at a different rate than the yarn being pulled into the weaving machine.

5. The apparatus of claim 2, wherein the computing device is operative to automatically control operation of the weaving machine.

6. The apparatus of claim 5, wherein the computing device is configured to determine how closely to apply a weft.

7. The apparatus of claim 5, wherein the computing device is operative to control continuous generation of a warp with a plurality of patterns by controlling when the yarn extension device connects the first strand of yarn from one of the plurality of yarn packages to the second strand of yarn from one of the plurality of regenerating yarn packages, the type of yarn to select from the plurality of yarn packages, and how much yarn is accumulated onto the regenerating yarn package.

8. The apparatus of claim 5, wherein the computing device is operative to control continuous generation of a warp with a same pattern by controlling when the yarn extension device connects the first strand of yarn from one of the plurality of yarn packages to the second strand of yarn from one of the plurality of regenerating yarn packages, the type of yarn to select from the plurality of yarn packages, and how much yarn is accumulated onto the regenerating yarn package.

9. The apparatus of claim 1, further including a plurality of yarn extension devices, wherein each yarn extension device is coupled to a subset of yarn packages and a subset of regenerating yarn packages.

10. The apparatus of claim 1, further comprising a plurality of motors, each of the motors being configured within one of the plurality of regenerating yarn packages.

11. The apparatus of claim 1, wherein the at least one motor is coupled to a plurality of gears, each gear being coupled to one of the plurality of regenerating yarn packages.

12. The apparatus of claim 11, wherein the at least one motor is operative to drive at least one of the gears at a time.

13. The apparatus of claim 1, wherein the computing device automatically selects the first strand of yarn from one of the plurality of yarn packages to be connected to the second strand of yarn from one of the plurality of regenerating yarn packages in the yarn extension device.

14. The apparatus of claim 1, wherein the computing device is configured to determine how many times a regenerating yarn package must rotate to accumulate a length of yarn specified by a user.

15. A method for manufacturing textiles, comprising the steps of:

configuring a plurality of yarn packages, each comprising a bobbin so that each yarn package has a strand of yarn wound around the bobbin;

mounting a plurality of regenerating yarn packages onto a creel so that each regenerating yarn package has accumulated thereon a strand of yarn;

coupling a yarn extension device to the plurality of yarn packages and the plurality of regenerating yarn packages, the yarn extension device having a first plurality of inputs each coupled to a strand of yarn from one of the plurality of yarn packages, a second plurality of inputs each coupled to a strand of yarn from one of the plurality of regenerating yarn packages, and a yarn joining device operative to join yarn from any one of the first plurality of inputs to yarn from any one of the second plurality of inputs;

configuring at least one motor to control the plurality of regenerating yarn packages; and configuring a computing device to automatically control operation of the yarn extension device, the at least one motor, and the weaving machine, in order to perform the steps of:

joining, with the yarn extension device, a first strand from one of the first plurality of inputs to a second strand from one of the second plurality of inputs in order to form a joined strand, rotating one of the regenerating yarn packages to accumulate the joined strand of yarn, pulling a parallel set of yarns from a predetermined number of the plurality of regenerating yarn packages in a predetermined arrangement to form a warp, feeding the warp into a weaving machine, and applying a weft over-and-under the parallel set of yarns in a perpendicular manner to generate fabric.

16. The method of claim 15, wherein each regenerating yarn package acts to reset a yarn tension such that a tension of the yarn pulled from the regenerating yarn package is independent of a tension of the yarn accumulated by the regenerating yarn package.

17. The method of claim 15, wherein the creel replenishes yarn on the warp at a same rate that the yarn is being pulled into the weaving machine.

18. The method of claim 15, wherein the creel replenishes yarn on the warp at a different rate than the yarn being pulled into the weaving machine.

* * * * *